US007912404B2

(12) United States Patent
Hoshi et al.

(10) Patent No.: US 7,912,404 B2
(45) Date of Patent: Mar. 22, 2011

(54) CARTRIDGE AND ELECTROPHOTOGRAPHIC IMAGE FORMING APPARATUS

(75) Inventors: Nobuharu Hoshi, Numazu (JP); Toshiyuki Karakama, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 545 days.

(21) Appl. No.: 11/948,533

(22) Filed: Nov. 30, 2007

(65) Prior Publication Data

US 2008/0145095 A1 Jun. 19, 2008

(30) Foreign Application Priority Data

Dec. 13, 2006 (JP) ..... 2006-336008
Nov. 26, 2007 (JP) ..... 2007-304501

(51) Int. Cl.
*G03G 15/00* (2006.01)
*G03G 21/16* (2006.01)
*G03G 15/04* (2006.01)

(52) U.S. Cl. ..... 399/111; 399/110; 399/119

(58) Field of Classification Search ..... 399/90, 399/110, 111, 119
See application file for complete search history.

(56) References Cited

U.S. PATENT DOCUMENTS 5,294,960 A 3/1994 Nomura et al. ..... 355/210
5,500,714 A 3/1996 Yashiro et al. ..... 355/200
5,543,898 A * 8/1996 Shishido et al. ..... 399/111
5,585,895 A 12/1996 Yashiro et al. ..... 355/215
5,617,579 A 4/1997 Yashiro et al. ..... 399/114
5,619,309 A 4/1997 Yashiro et al. ..... 399/111
5,623,328 A 4/1997 Tsuda et al. ..... 399/111
5,638,161 A 6/1997 Numagami et al. ..... 399/111
5,682,579 A 10/1997 Nomura et al. ..... 399/11
5,689,774 A 11/1997 Shishido et al. ..... 399/111
5,745,823 A 4/1998 Goto et al.
5,749,027 A 5/1998 Ikemoto et al. ..... 399/113
5,774,766 A 6/1998 Karakama et al. ..... 399/111

(Continued)

FOREIGN PATENT DOCUMENTS

EP 1 241 535 9/2002

(Continued)

OTHER PUBLICATIONS

International Search Report and Written Opinion of the International Searching Authority, mailed Apr. 16, 2008, issued in PCT application PCT/JP2007/073895.

(Continued)

*Primary Examiner* — David M Gray
*Assistant Examiner* — Francis Gray
(74) *Attorney, Agent, or Firm* — Fitzpatrick, Cella, Harper & Scinto

(57) ABSTRACT

A cartridge detachably mountable to an electrophotographic image forming apparatus main body for forming an image on a recording medium. The apparatus main body includes: a main body guide; a restraining unit movable with respect to the main body guide; and a main body abutting portion. The cartridge includes: a frame; a guided portion protruding from the frame so as to be guided by the main body guide, and abutting on the restraining unit as the cartridge is being mounted in the apparatus main body to be restrained from moving to the downstream side in a mounting direction; and a moving member movable with respect to the frame to abut on the main body abutting portion to be moved to act on the restraining unit to move the restraining unit to an allowable position in which the guided portion is allowed to move to the downstream side.

15 Claims, 33 Drawing Sheets

U.S. PATENT DOCUMENTS

| | | | | |
|---|---|---|---|---|
| 5,828,928 | A | 10/1998 | Sasago et al. | 399/111 |
| 5,878,310 | A | 3/1999 | Noda et al. | 399/117 |
| 5,890,036 | A | 3/1999 | Karakama et al. | 399/119 |
| 5,907,749 | A | 5/1999 | Nomura et al. | 399/113 |
| 5,920,752 | A | 7/1999 | Karakama et al. | 399/111 |
| 5,953,560 | A | 9/1999 | Numagami et al. | 399/111 |
| 5,987,278 | A | 11/1999 | Nomura et al. | 399/109 |
| 6,064,842 | A | 5/2000 | Takeuchi et al. | 399/111 |
| 6,070,028 | A | 5/2000 | Odagawa et al. | 399/104 |
| 6,078,763 | A | 6/2000 | Hoshi | 399/111 |
| 6,101,354 | A | 8/2000 | Nakagawa et al. | 399/225 |
| 6,118,961 | A | 9/2000 | Nomura et al. | 399/113 |
| 6,144,821 | A | 11/2000 | Oguma | 399/114 |
| 6,229,974 | B1 * | 5/2001 | Noda | 399/111 |
| 6,253,036 | B1 | 6/2001 | Karakama et al. | 399/27 |
| 6,266,500 | B1 | 7/2001 | Numagami et al. | 399/104 |
| 6,397,017 | B1 | 5/2002 | Sakai et al. | 399/27 |
| 6,397,018 | B1 | 5/2002 | Matsumoto et al. | 399/27 |
| 6,408,142 | B1 | 6/2002 | Takeuchi et al. | 399/13 |
| 6,408,143 | B2 | 6/2002 | Sakurai et al. | 399/27 |
| 6,442,359 | B1 | 8/2002 | Numagami et al. | 399/111 |
| 6,463,223 | B1 | 10/2002 | Karakama et al. | 399/27 |
| 6,463,233 | B2 | 10/2002 | Kojima et al. | 399/111 |
| 6,577,831 | B1 | 6/2003 | Numagami et al. | 399/111 |
| 6,625,413 | B2 | 9/2003 | Oguma et al. | 399/222 |
| 6,654,567 | B2 | 11/2003 | Karakama et al. | 399/25 |
| 6,658,224 | B2 | 12/2003 | Yokoi et al. | 399/113 |
| 6,704,525 | B2 | 3/2004 | Oguma et al. | 399/27 |
| 6,738,589 | B2 | 5/2004 | Karakama et al. | 399/111 |
| 6,782,222 | B2 | 8/2004 | Ito et al. | 399/111 |
| 6,804,475 | B2 | 10/2004 | Oguma et al. | 399/27 |
| 6,804,483 | B2 | 10/2004 | Yokoi et al. | 399/113 |
| 6,859,627 | B2 | 2/2005 | Karakama et al. | 399/27 |
| 6,865,357 | B2 | 3/2005 | Fujita et al. | 399/111 |
| 6,892,035 | B2 | 5/2005 | Matsumoto et al. | 399/27 |
| 6,898,392 | B2 | 5/2005 | Karakama et al. | 399/90 |
| 6,987,938 | B2 | 1/2006 | Murakami et al. | 399/111 |
| 6,990,302 | B2 | 1/2006 | Toba et al. | 399/114 |
| 7,006,776 | B2 | 2/2006 | Matsuzaka et al. | 399/111 |
| 7,024,131 | B2 | 4/2006 | Komatsu et al. | 399/109 |
| 7,027,756 | B2 | 4/2006 | Hoshi et al. | 399/111 |
| 7,072,594 | B2 | 7/2006 | Hoshi et al. | 399/27 |
| 7,095,967 | B2 | 8/2006 | Karakama et al. | 399/27 |
| 7,127,194 | B2 | 10/2006 | Hoshi et al. | 399/111 |
| 7,184,682 | B2 | 2/2007 | Chadani et al. | 399/90 |
| 7,346,293 | B2 | 3/2008 | Suzuki et al. | 399/111 |
| 7,349,649 | B2 | 3/2008 | Hoshi et al. | 399/111 |
| 2003/0185587 | A1 * | 10/2003 | Kawai et al. | 399/111 |
| 2004/0081483 | A1 | 4/2004 | Arimitsu | 399/111 |
| 2005/0226648 | A1 * | 10/2005 | Abe et al. | 399/90 |
| 2007/0141889 | A1 | 6/2007 | Chadani et al. | 439/357 |

FOREIGN PATENT DOCUMENTS

| | | |
|---|---|---|
| EP | 1 363 169 | 11/2003 |
| EP | 1 621 942 | 2/2006 |
| JP | 5-297772 | 11/1993 |
| JP | 5-303242 | 11/1993 |
| JP | 2000-89567 | 3/2000 |

OTHER PUBLICATIONS

Japanese Office Action dated Jun. 1, 2010, in Japanese Application No. 2007-304501, and English-language translation thereof.

Japanese Office Action dated Sep. 15, 2009, in Japanese Application No. 2007-304501, and English-language translation thereof.

* cited by examiner

CARTRIDGE AND ELECTROPHOTOGRAPHIC IMAGE FORMING APPARATUS

BACKGROUND OF THE INVENTION

1. Field of the Invention

The present invention relates to a cartridge detachably mountable to an electrophotographic image forming apparatus for forming an image on a recording medium, and the electrophotographic image forming apparatus.

2. Related Background Art

Conventionally, in an electrophotographic image forming apparatus employing an electrophotographic image forming process, a process cartridge, into which an electrophotographic photosensitive member and a process unit acting on the electrophotographic photosensitive member are integrally incorporated as a unit, is detachably mountable to a main body of the image forming apparatus. Furthermore, in Japanese Patent Application Laid-Open No. 05-303242, known is the construction in which, when mounting a process cartridge to an image forming apparatus main body, a guided portion of the process cartridge is guided by a main body guide, and thus the process cartridge is guided to a positioning portion of the image forming apparatus main body.

Conventionally, to improve operability upon mounting the process cartridge in the image forming apparatus main body, a main body guide member needs to have a shape to smoothly guide a guided portion. However, there are some cases where downsizing of an electrophotographic image forming apparatus is affected by the shape of the main body guide member.

SUMMARY OF THE INVENTION

Therefore, the present invention provides a cartridge and an electrophotographic image forming apparatus achieving downsizing of an electrophotographic image forming apparatus main body, and further achieving higher operability when dismounting and mounting the cartridge to the electrophotographic image forming apparatus main body.

In addition, the present invention provides a cartridge detachably mountable to an electrophotographic image forming apparatus main body for forming an image on a recording medium, the electrophotographic image forming apparatus main body having: a main body guide; a restraining unit provided movably with respect to the main body guide; and a main body abutting. The cartridge comprises: a frame; a guided portion protruding from the frame so as to be guided by the main body guide, and abutting on the restraining unit as the cartridge is being mounted to the image forming apparatus main body so as to be restrained from moving to a downstream side of the apparatus in a mounting direction; and a moving member provided movably with respect to the frame, abutting on the main body abutting portion so as to be moved to act on the restraining unit, thereby moving the restraining unit on which the guided portion abuts to an allowable position of allowing the guided portion to move to the downstream side in the mounting direction.

Further, the present invention provides an electrophotographic image forming apparatus to which a cartridge is detachably mountable for forming an image on a recording medium. The electrophotographic image forming apparatus comprises: (i) a main body guide; (ii) a restraining unit provided movably with respect to the main body guide; (iii) a main body abutting portion; and (iv) a mounting portion to which the cartridge is detachably mountable. The cartridge includes: a frame; a guided portion protruding from the frame so as to be guided by the main body guide, and abutting on the restraining unit as the cartridge is being mounted to an apparatus main body of the electrophotographic image forming apparatus so as to be restrained from moving to a downstream side of the apparatus in a mounting direction; and a moving member provided movably with respect to the frame, abutting on the main body abutting portion so as to be moved to act on the restraining unit, thereby moving the restraining unit on which the guided portion abuts to an allowable position of allowing the guided portion to move to the downstream side in the mounting direction. The apparatus also includes (v) a conveying unit conveying the recording medium.

Further features of the present invention will become apparent from the following description of exemplary embodiments with reference to the attached drawings.

DESCRIPTION OF THE EMBODIMENTS

Embodiment 1

Hereinafter, a first exemplary embodiment according to the present invention will be described in detail referring to the accompanying drawings. The longitudinal direction of a process cartridge is the direction (a direction of the axis of rotation of a photosensitive drum or a direction substantially orthogonal to) intersecting the direction of mounting the process cartridge into an electrophotographic image forming apparatus main body. Furthermore, the terms "left" and "right" when used in connection with the process cartridge refer to the left or the right direction as viewed along the direction of mounting the process cartridge into the electrophotographic image forming apparatus main body. In addition, the top face of the process cartridge is the face positioned at the top of the cartridge in the state in which the process cartridge is mounted in the electrophotographic image forming apparatus main body, and the bottom face is the face positioned at the bottom of the cartridge in that state.

Figure 1:
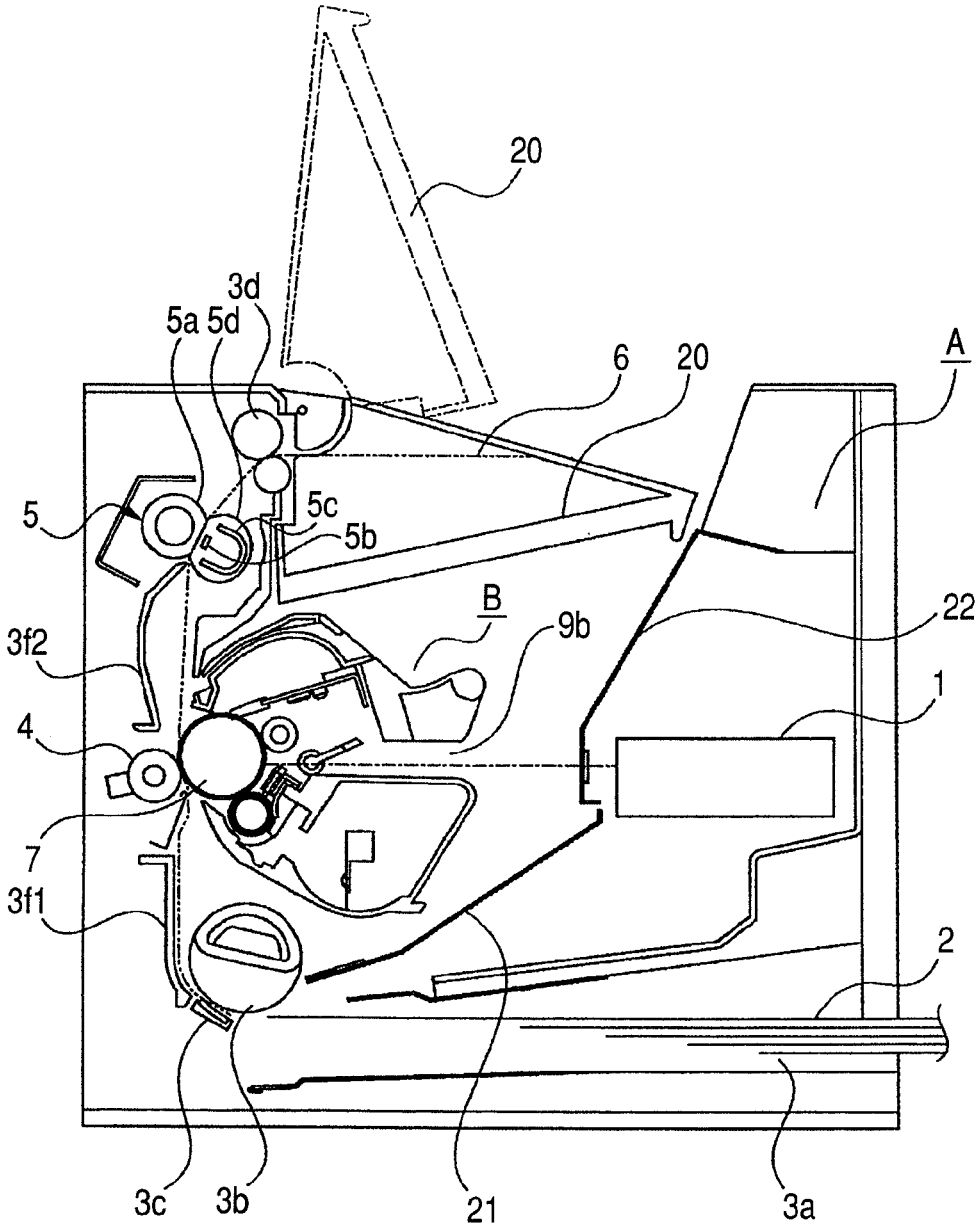
FIG. 1 is a schematic sectional view illustrating an overall image forming apparatus in a first embodiment.
Figure 2:
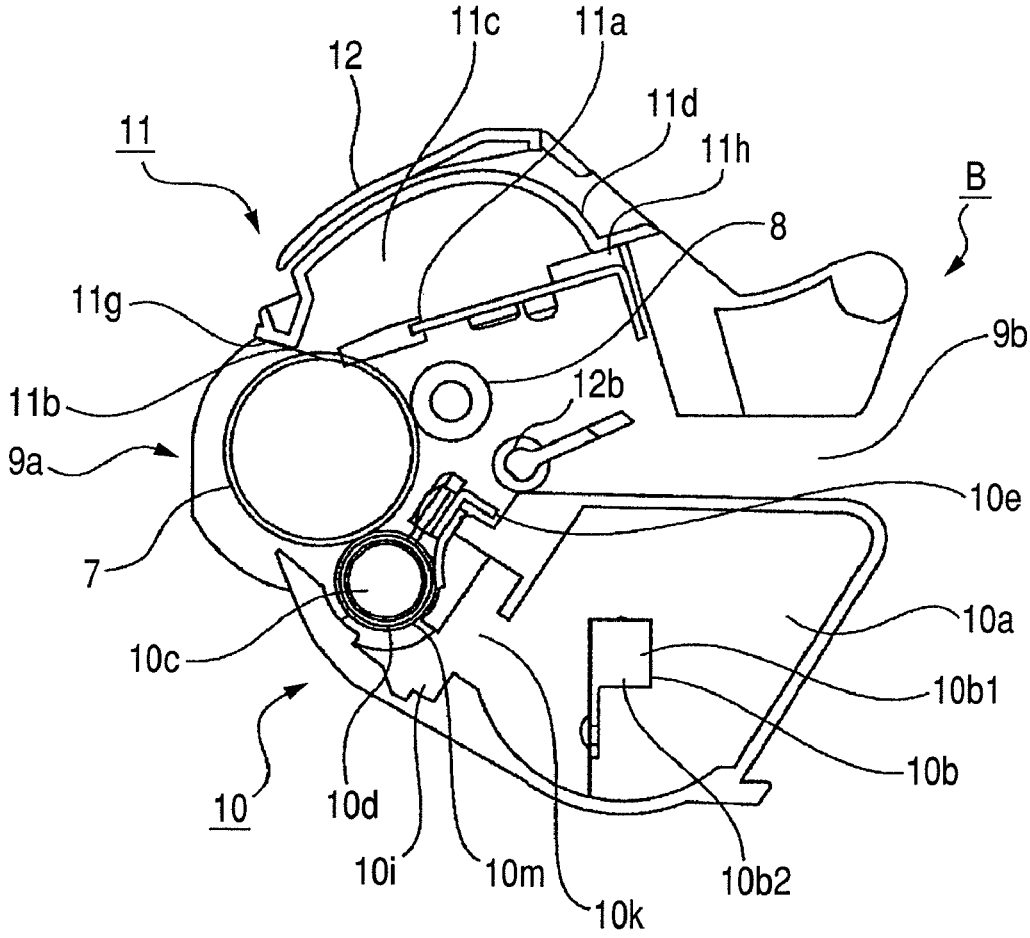
FIG. 2 is a schematic sectional view of a process cartridge in the first embodiment.

First, the process cartridge and the electrophotographic image forming apparatus main body into which the process cartridge is detachably mountable will be specifically described with reference to FIGS. 1 and 2. Incidentally, FIG. 1 is a schematic sectional view illustrating the construction of the electrophotographic image forming apparatus main body in which the process cartridge is mounted. FIG. 2 is a schematic sectional view illustrating the construction of the process cartridge.

(Overall Construction)

In this electrophotographic image forming apparatus main body (hereinafter referred to as "apparatus main body") A, as illustrated in FIG. 1, information light, generated according to image information, from an optical system 1 functioning as an optical unit, irradiates an electrophotographic photosensitive member (hereinafter referred to as "photosensitive drum") 7 of a drum shape. As a result, an electrostatic latent image is formed on the photosensitive drum 7. This electrostatic latent image is developed with a developer (hereinafter referred to as "toner") to form a toner image. Then, in synchronism with the formation of the toner image, a recording medium (a recording sheet, an OHP sheet, cloth and the like) 2 is fed from a sheet feeding portion (cassette) 3*a* and separated one by one by a pickup roller 3*b* and a pressure member 3*c* in pressure contact with the pickup roller 3*b*. The toner image having been formed on the photosensitive drum 7 of the process cartridge (hereinafter referred to as a cartridge) B is transferred, by the application of a voltage to a transfer roller 4 acting as a transfer unit, on the recording medium 2 having been conveyed along a conveying guide 3*f*1. Moreover, the recording medium 2 having been transferred with the toner image is conveyed to a fixing unit 5 along a conveying guide 3*f*2. This fixing unit 5 includes a drive roller 5*a* and a fixing rotary member 5*d* made of a tubular sheet that contains a heater 5*b* therein and is rotatably supported by a support 5*c*. Then, the fixing unit 5 applies heat and pressure to the recording medium 2 being passed to fix the transferred toner image. The recording medium 2 on which the transferred toner image has been fixed is conveyed by a discharge roller 3*d* and discharged to a discharge portion 6 through a reversing and conveying path. Incidentally, although in this embodiment, a conveying unit is formed of the pickup roller 3*b*, the pressure member 3*c*, the discharge roller 3*d* and the like, the present invention is not limited thereto.

(Process Cartridge Construction)

The cartridge B is the one that includes the photosensitive drum 7 and at least one process unit. As a process unit, there are, for example, a charging unit charging the photosensitive drum 7, a developing unit developing an electrostatic latent image that is formed on the photosensitive drum 7, and a cleaning member for cleaning a toner remaining on the photosensitive drum 7. In the cartridge B according to this embodiment, as illustrated in FIG. 2, the photosensitive drum 7 as an electrophotographic photosensitive member having a photoconductive layer is driven to rotate, and the charging roller 8 as a charging unit has applied thereto a voltage to uniformly charge the surface of the photosensitive drum 7. The photosensitive drum 7 in this charged state is exposed to information light (light image) based on image information from the optical system 1 through an exposure opening 9*b*. Then, it is constructed such that an electrostatic latent image is formed on the surface of the photosensitive drum 7, and this electrostatic latent image is developed by the developing unit 10.

In the developing unit 10, the toner in a toner containing portion 10*a* is fed out by a rotatable feed member 10*b*. Then, a developing roller 10*d* as a developing rotary member (developer carrying member) containing a stationary magnet 10*c* therein is rotated, and a toner layer applied with a triboelectrification charge by a developing blade 10*e* is formed on the surface of the developing roller 10*d*. Further, the developing roller 10*d* transfers the toner onto the photosensitive drum 7 based on the electrostatic latent image, thereby forming a toner image to visualize the latent image.

Then, the transfer roller 4 is applied with the voltage of a polarity opposite to that of the toner image to transfer the toner image on the recording medium 2. After the transfer, the toner remaining on the photosensitive drum 7 is scraped off by a cleaning blade 11*a* that is provided at the cleaning member 11, and is prevented from being leaked to the outside of a removed toner containing portion 11*c* by a scooping sheet 11*b*.

(Construction of Mounting/Dismounting a Process Cartridge from an Image Forming Apparatus Main Body)

A mounting construction for mounting the cartridge B that is assembled as described above in the apparatus main body A will be described referring to the drawings.

Figure 3:
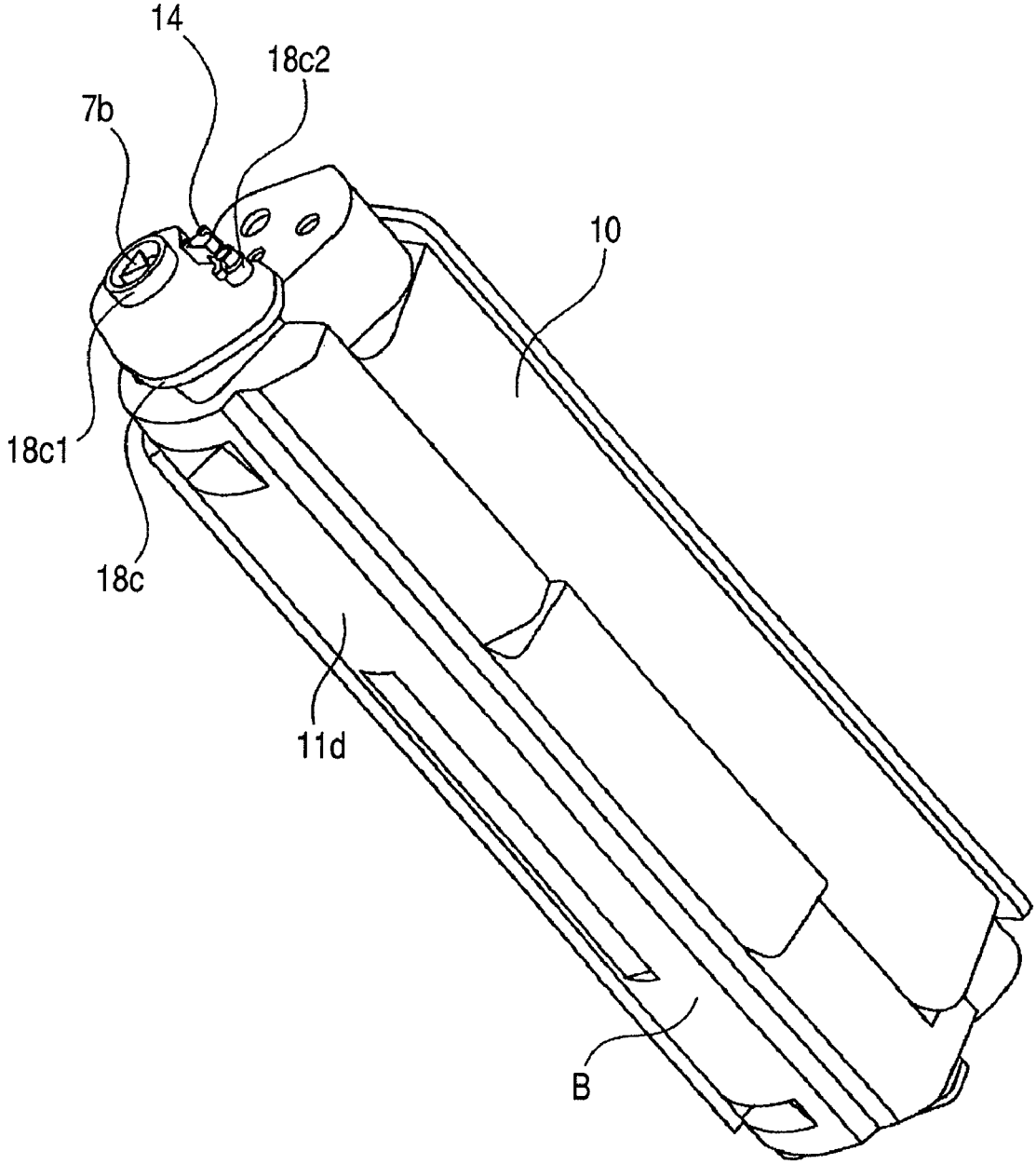
FIG. 3 is a schematic perspective view of the process cartridge in the first embodiment.
Figure 4:
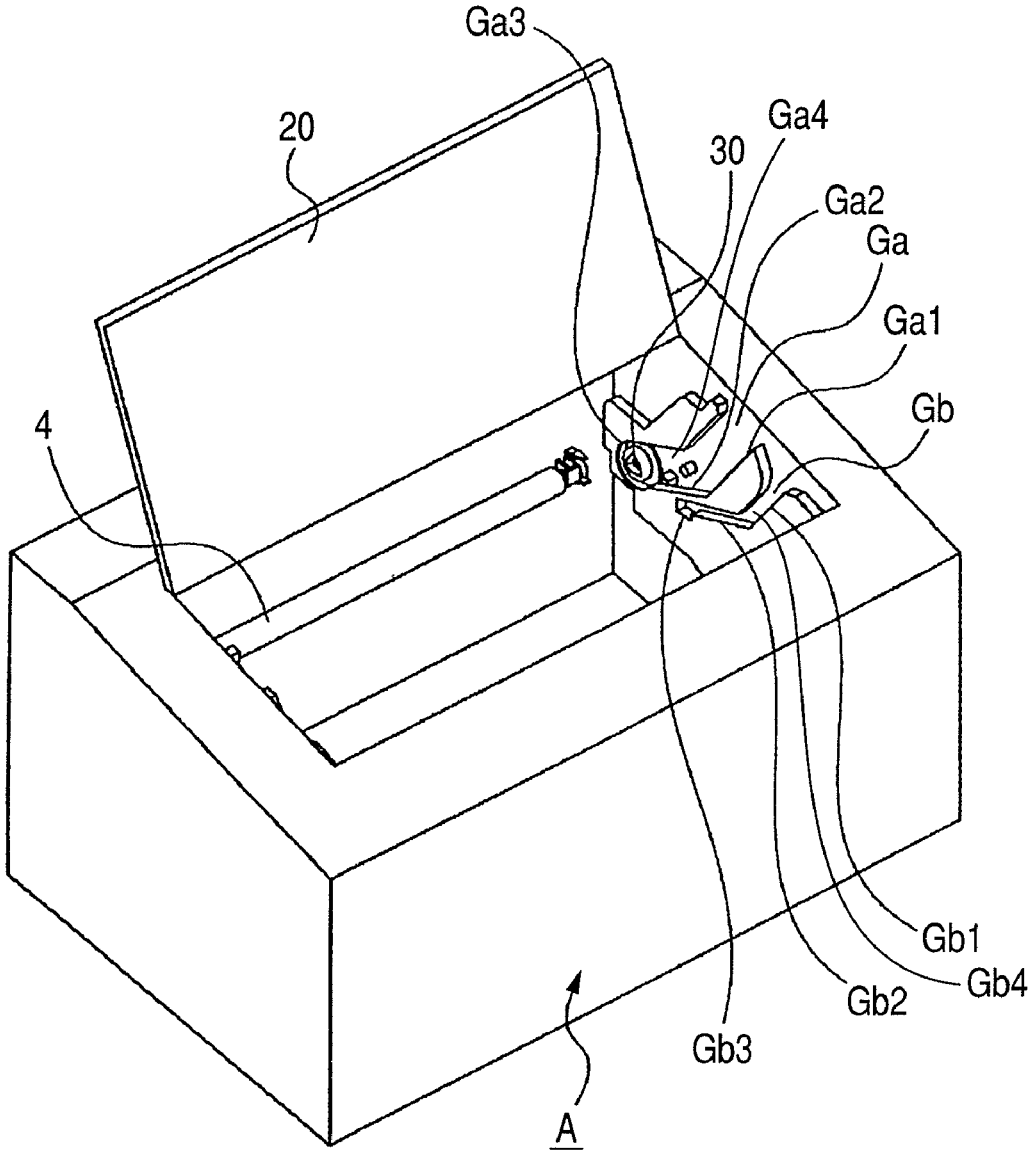
FIG. 4 is a perspective view in the vicinity of a guide groove on the right side in the longitudinal direction of an image forming apparatus main body in the first embodiment.
Figure 5:
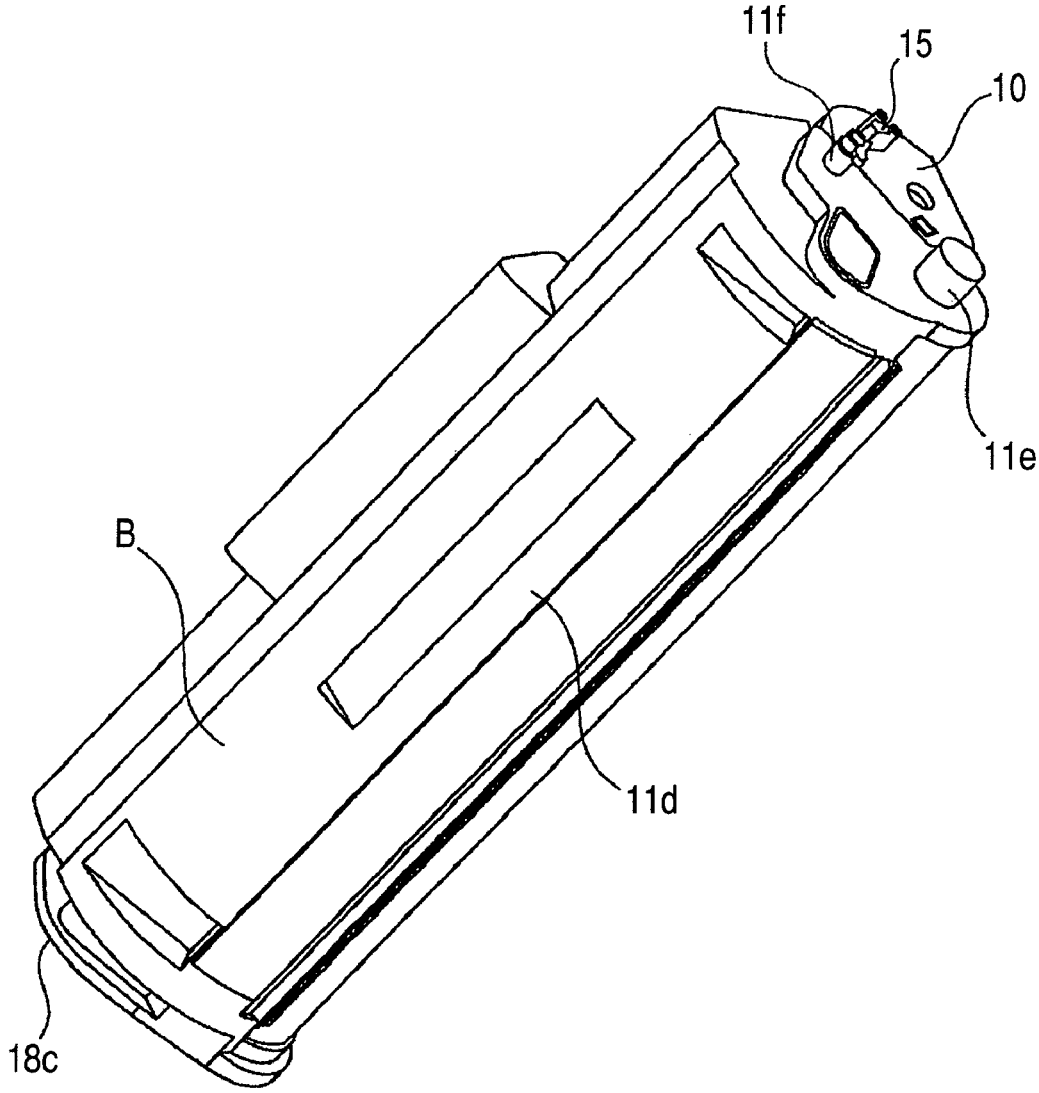
FIG. 5 is a schematic perspective view of the process cartridge in the first embodiment.
Figure 6:
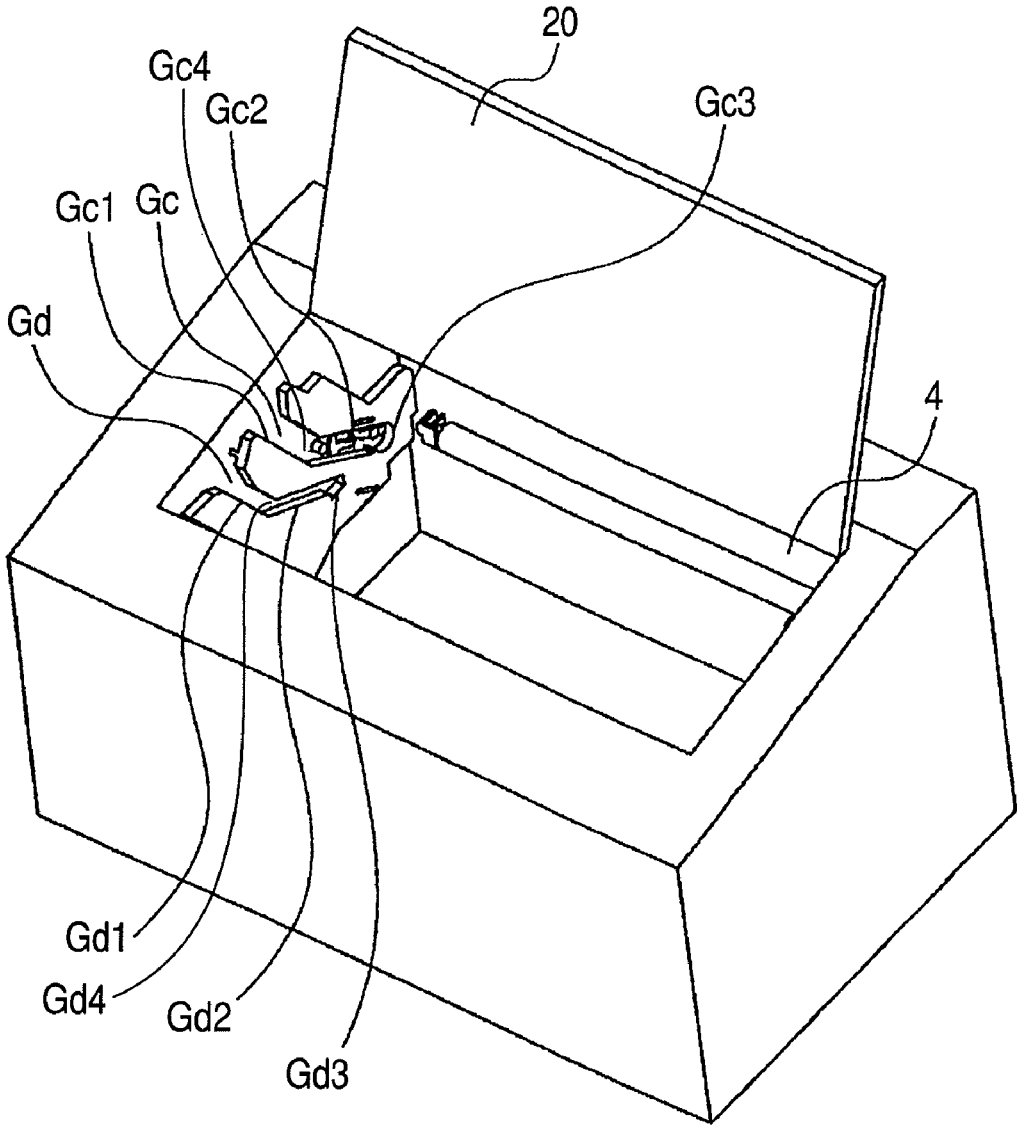
FIG. 6 is a perspective view in the vicinity of a guide groove on the left side in the longitudinal direction of the image forming apparatus main body in the first embodiment.

FIGS. 3 and 5 are schematic perspective views of the cartridge, and FIGS. 4 and 6 are perspective views in the vicinity of a guide groove on the right side and on the left side in the longitudinal direction of the image forming apparatus main body respectively.

As illustrated in FIG. 3, at a bearing member 18*c* attached to a cleaning frame 11*d* on the right side in the longitudinal direction of the cartridge B, there are provided a first guided portion 18*c*1 and a second guided portion 18*c*2. The first guided portion 18*c*1 is of a cylindrical shape that is formed to protrude coaxially with the axis of rotation of the photosensitive drum 7. In addition, the second guided portion 18*c*2 is a rotation stopper for determining the posture of the cartridge B about the rotation axis of the photosensitive drum 7. Furthermore, there is provided at a longitudinal direction end portion of the second guided portion 18*c*2 a moving member 14 that is rotatably provided at the longitudinal end of the second guided portion 18*c*2.

Incidentally, the first guided portion 18*c*1 and the second guided portion 18*c*2 are positioned outside of the developing unit 10 in the longitudinal direction. Furthermore, an end face coupling 7*b* receiving a driving force from the apparatus main body A is disposed inside of the bearing member 18*c* in the longitudinal direction.

Figure 19:
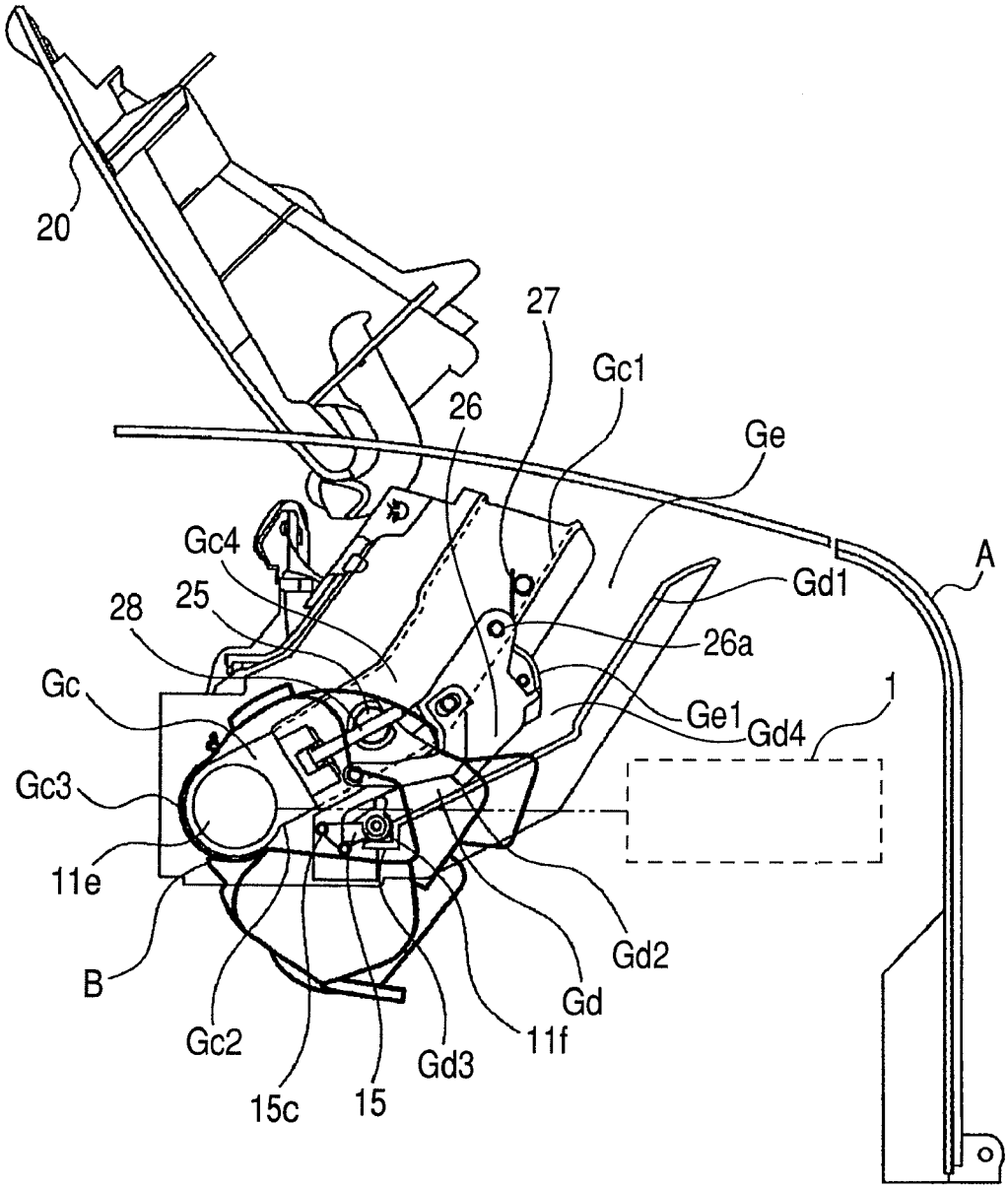
FIG. 19 is a schematic sectional view in the state in which mounting of the process cartridge in the image forming apparatus main body has been completed in the first embodiment.

In the apparatus main body A, as illustrated in FIG. 4, to guide the first guided portion 18*c*1 and the second guided portion 18*c*2 of the cartridge B to the image forming position (mounting portion Ga3, Gc3), there are formed a first guide groove Ga as a first main body guide and a second guide groove Gb as a second main body guide. The guide grooves Ga, Gb include inclined surfaces (upstream-side guide surfaces Ga1, Gb1) inclined from the top to the bottom thereof toward the downstream side (into the interior) in the mounting direction of the cartridge B. Further, the guide grooves Ga, Gb further include inclined surfaces (downstream-side guide surfaces Ga2, Gb2) at a different angle toward the downstream side (into the interior) in the mounting direction. That is, the first guide groove Ga includes a first bent portion Ga4, and the second guide groove Gb includes a second bent portion Gb4. Incidentally, the purpose of the guide grooves Ga, Gb including these two inclined surfaces at different angles is to downsize the apparatus main body A and to make the dead space in the apparatus main body A smaller. That is, as illustrated in FIG. 19, the optical unit 1 can be disposed below the upstream-side guide surface Gb1, thus enabling the efficient use the space in the apparatus main body A.

On the other hand, as illustrated in FIG. 5, on the other longitudinal direction end side (on the left side), there are formed a first guided portion 11*e* of a cylindrical shape that is provided coaxially with the photosensitive drum 7, and a second guided portion 11*f* for determining the posture of the cartridge B at the time of mounting. The first guided portion 11*e* and the second guided portion 11*f* are parts of the cleaning frame 11*d*. In addition, as with one end side, there is a moving member 15 that is movably (rotatably) provided coaxially with the second guided portion 11*f* at the longitudinal direction end portion of the second guided portion 11*f*. Incidentally, the first guided portion 11*e* and the second guided portion 11*f* are positioned outside of the developing unit 10 in the longitudinal direction. Moreover, the first guided portion 11*e* protrudes outward from the one end side of the cleaning frame 11*d* in the longitudinal direction. Furthermore, the second guided portion 11*f* protrudes outward from the other end side of the cleaning frame 11*d* in the longitudinal direction. In addition, in the apparatus main body A, as illustrated in FIG. 6, there are provided a first guide groove Gc as a first main body guide and a second guide groove Gd as a second main body guide, which are formed so as to keep, likewise, on the other longitudinal direction end side, a posture when mounting/dismounting the cartridge B, the posture of the cartridge B being determined on the bearing member 18*c* side. As with the guide construction on the right side in the longitudinal direction, the guide grooves Gc, Gd include inclined surfaces (upstream-side guide portions Gc1, Gd1) inclined from the top to the bottom thereof toward the downstream side (into the interior) in the mounting direction of the cartridge B. Further, the guide grooves Gc, Gd further include inclined surfaces (downstream-side guide portions Gc2, Gd2) at a different angle toward the downstream side (into the interior) in the mounting direction. That is, the first guide groove Gc includes a first bent portion Gc4, and the second guide groove Gd includes a second bent portion Gd4.

Now, the mounting/dismounting construction of the cartridge B with respect to the apparatus main body A will be described. Incidentally, in this mounting/dismounting construction, the guide grooves Ga, Gb and the guide grooves Gc, Gd of the apparatus main body A, and the first guided portion 18*c*1, 11*e* and the second guided portion 18*c*2, 11*f* and the moving members 14 and 15 of the cartridge B are in respective similar constructions. Accordingly, here, the construction on the left side when viewed in the mounting direction of the cartridge B into the apparatus main body A will be described.

Figure 7:
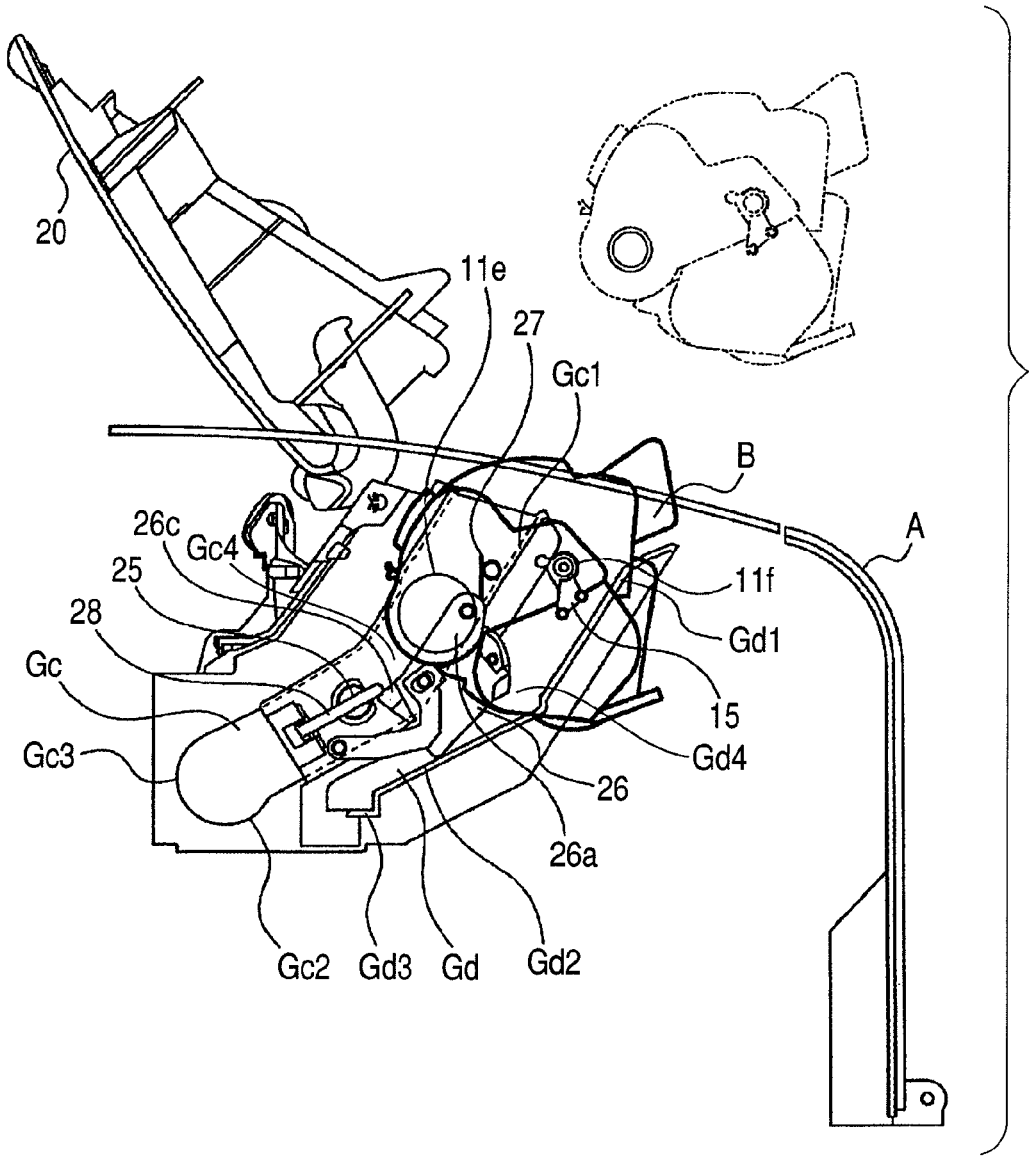
FIG. 7 is a schematic sectional view when mounting the process cartridge in the image forming apparatus main body in the first embodiment.
Figure 8:
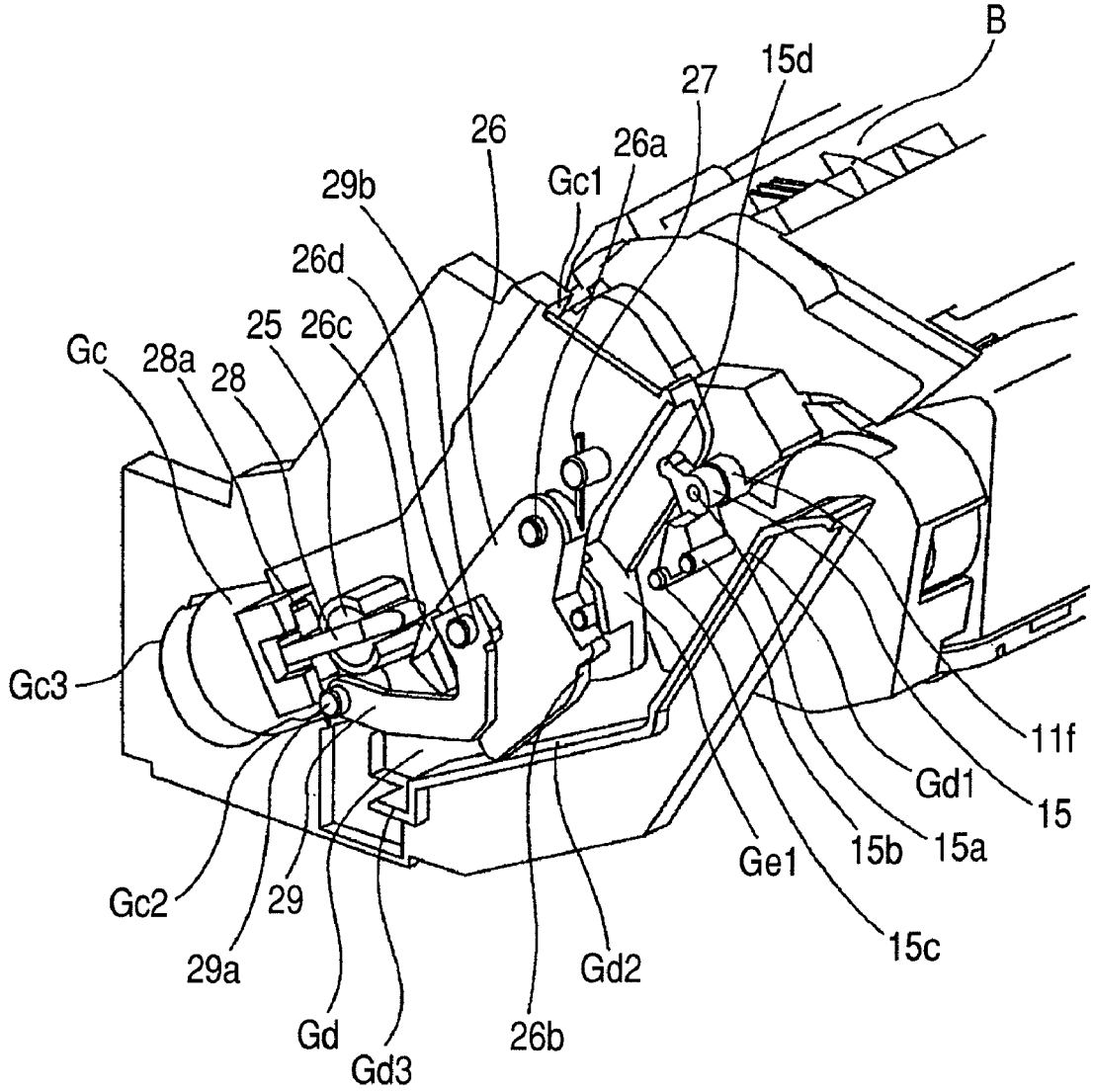
FIG. 8 is a schematic perspective view at the time of mounting the process cartridge in the image forming apparatus main body in the first embodiment.
Figure 9:
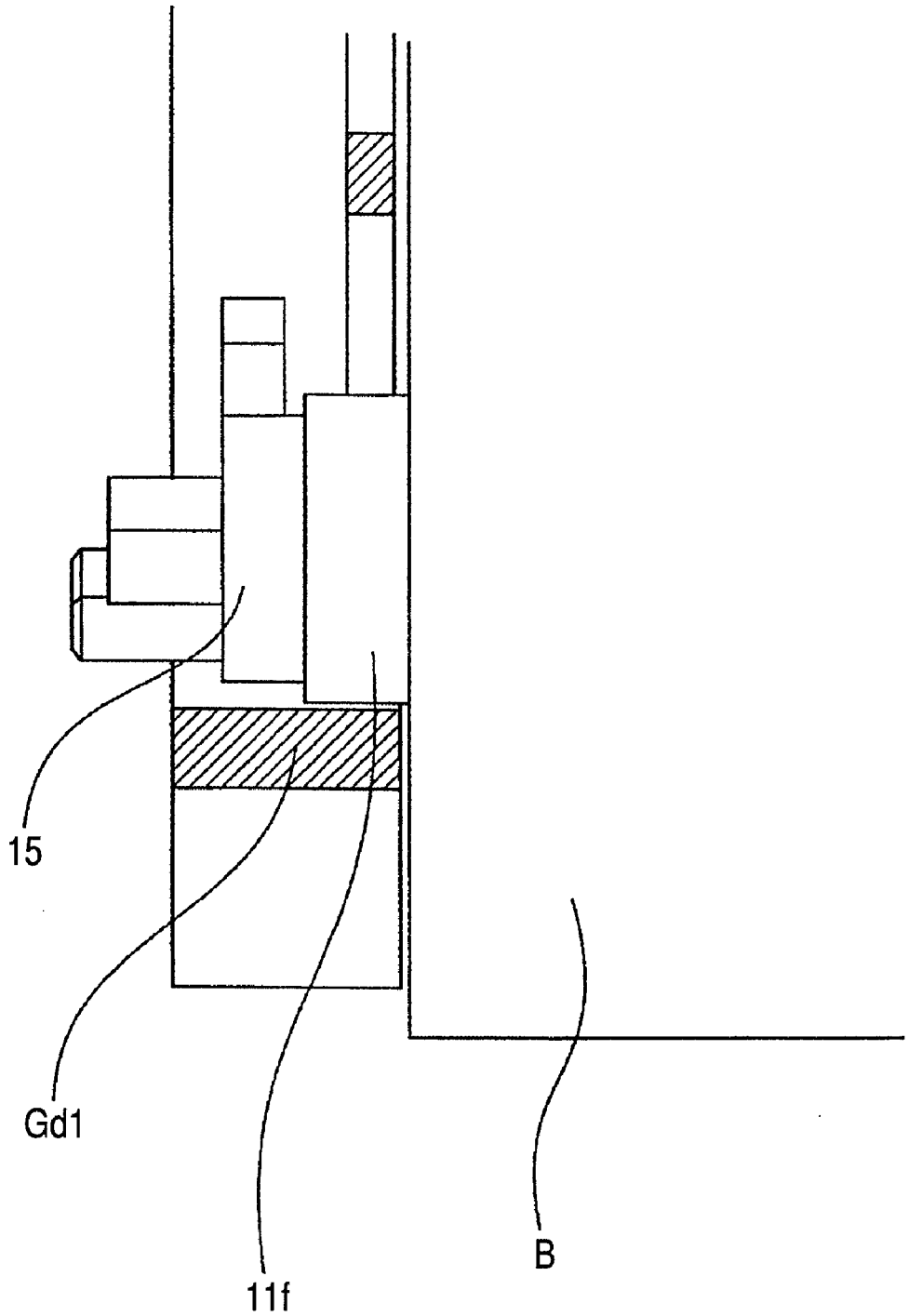
FIG. 9 is a schematic sectional view illustrating the construction of a guide portion between the process cartridge and the image forming apparatus main body in the first embodiment.
Figure 10:
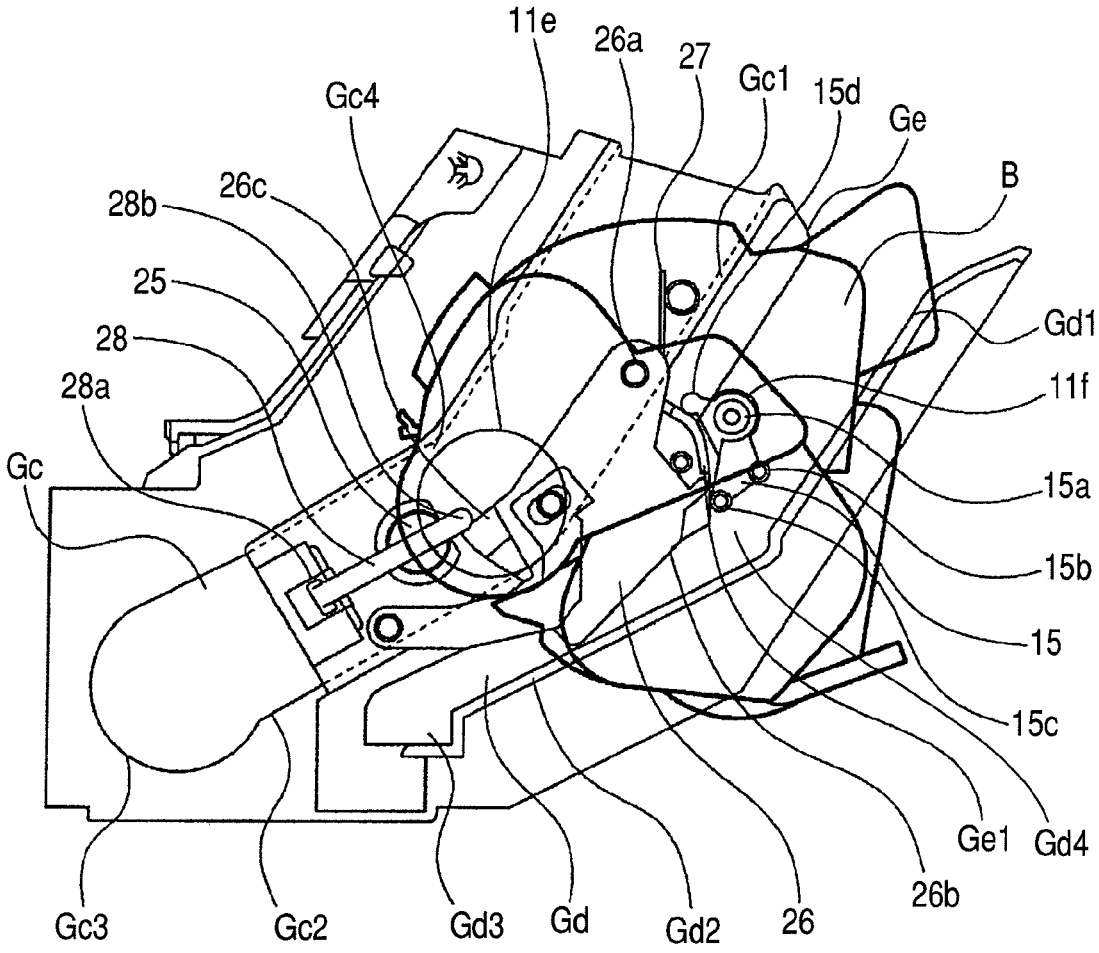
FIG. 10 is a schematic sectional view when mounting the process cartridge in the image forming apparatus main body in the first embodiment.
Figure 11:
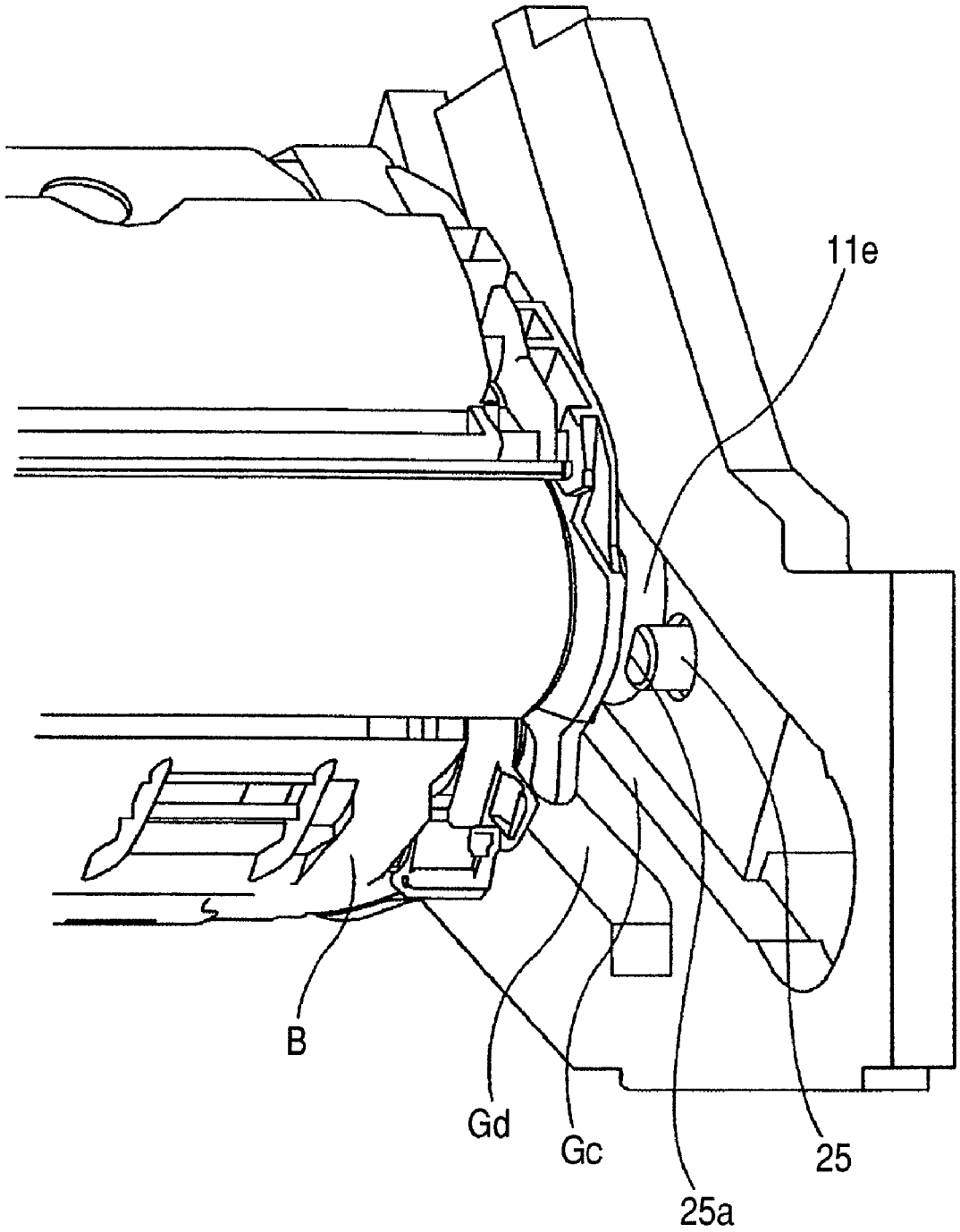
FIG. 11 is a schematic perspective view in the state in which the process cartridge abuts on an abutted portion of the image forming apparatus main body in the first embodiment.
Figure 12:
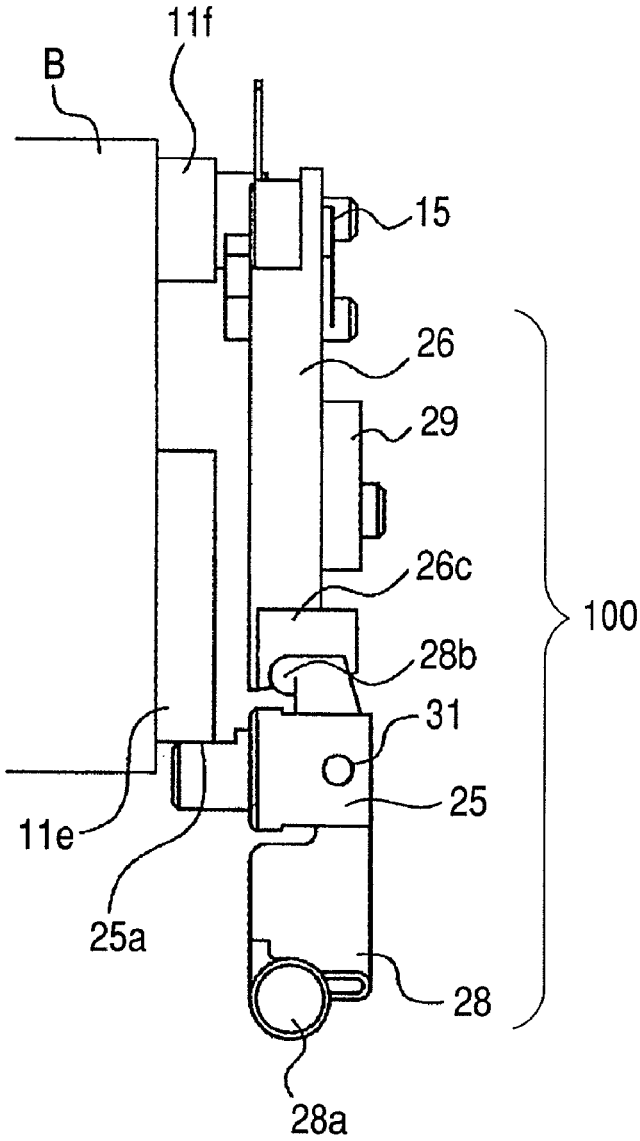
FIG. 12 is a schematic view illustrating a retreating mechanism of the abutted portion of the image forming apparatus main body in the first embodiment.

FIGS. 7 and 10 are schematic sectional views when mounting the cartridge B into the apparatus main body A. FIG. 8 is a schematic perspective view when mounting the cartridge B into the apparatus main body A. FIG. 9 is a schematic sectional view illustrating the construction of the guide groove. Furthermore, FIG. 11 is a schematic perspective view in the state in which the cartridge B abuts on an abutted member 25 as an element of a restraining unit 100 of the apparatus main body A. FIG. 12 is a schematic view illustrating the mechanism of the restraining unit 100 of the apparatus main body A.

First, as illustrated in FIGS. 7 to 9, an opening/closing door 20 of the apparatus main body A is opened, to expose the guide grooves Gc, Gd. The first guided portion 11*e* is placed on the first guide surface Gc1, which is bent to some extent at the front portion toward the apparatus, of the guide groove Gc and the second guided portion 11*f* is inserted into the guide groove Gd. In this state, the cartridge B is pushed into the interior of the apparatus main body A.

Here, the restraining unit 100 includes the abutted member 25, a releasing member 26, a helical torsion coil spring 27, a retreating lever 28, an arm member 29 and an engaging pin 31. In the vicinity of the first bent portion Gc4 of the first guided portion 11*e*, there is provided the abutted member 25. Here, the abutted member 25 will be described. As illustrated in FIGS. 8 and 12, the abutted member 25 is supported at the apparatus main body A so as to be capable of sliding in the longitudinal direction of the cartridge. Moreover, the abutted member 25 is connected to the retreating lever 28 by the engaging pin 31. Then, due to the rotating of retreating lever 28 about a shaft 28*a*, as described in detail later, the abutted member 25 moves in a sliding manner in the longitudinal direction of the cartridge. In normal operation, before any cartridge is mounted the abutted member 25 protrudes in the guide groove Gc to be in a restraining position for restraining the first guided portion 11*e* from moving to the downstream side in the mounting direction.

The releasing member 26 is provided in the proximity of the abutted member 25, and the releasing member 26 can turn about a rotation center 26*a*, and is biased in a counterclockwise direction by the helical torsion coil spring 27. In addition, the releasing member 26 includes an abutted portion 26*c* that is inclined in the longitudinal direction of the cartridge.

Now, the operation of mounting the cartridge B in the apparatus main body A will be described referring to the drawings.

Figure 13:
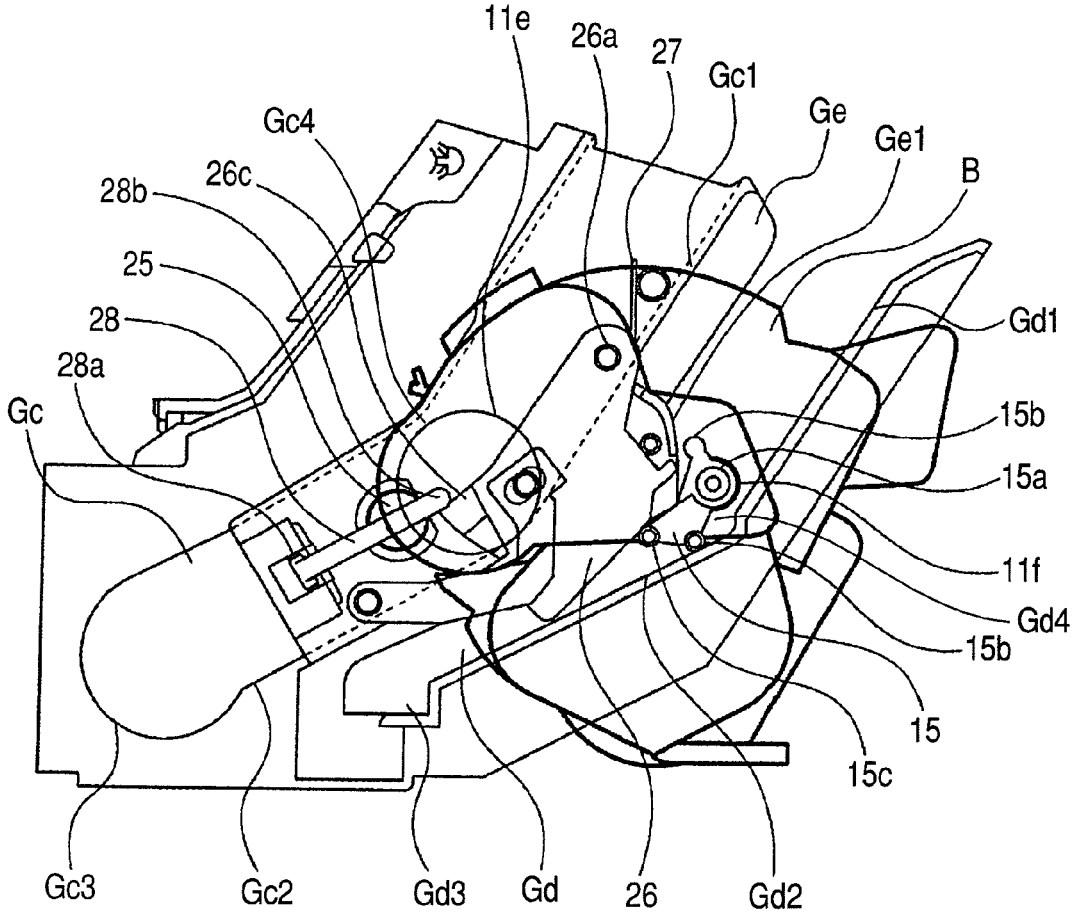
FIG. 13 is a schematic sectional view in the state in which a moving member of the process cartridge abuts on a releasing member in the first embodiment.
Figure 14:
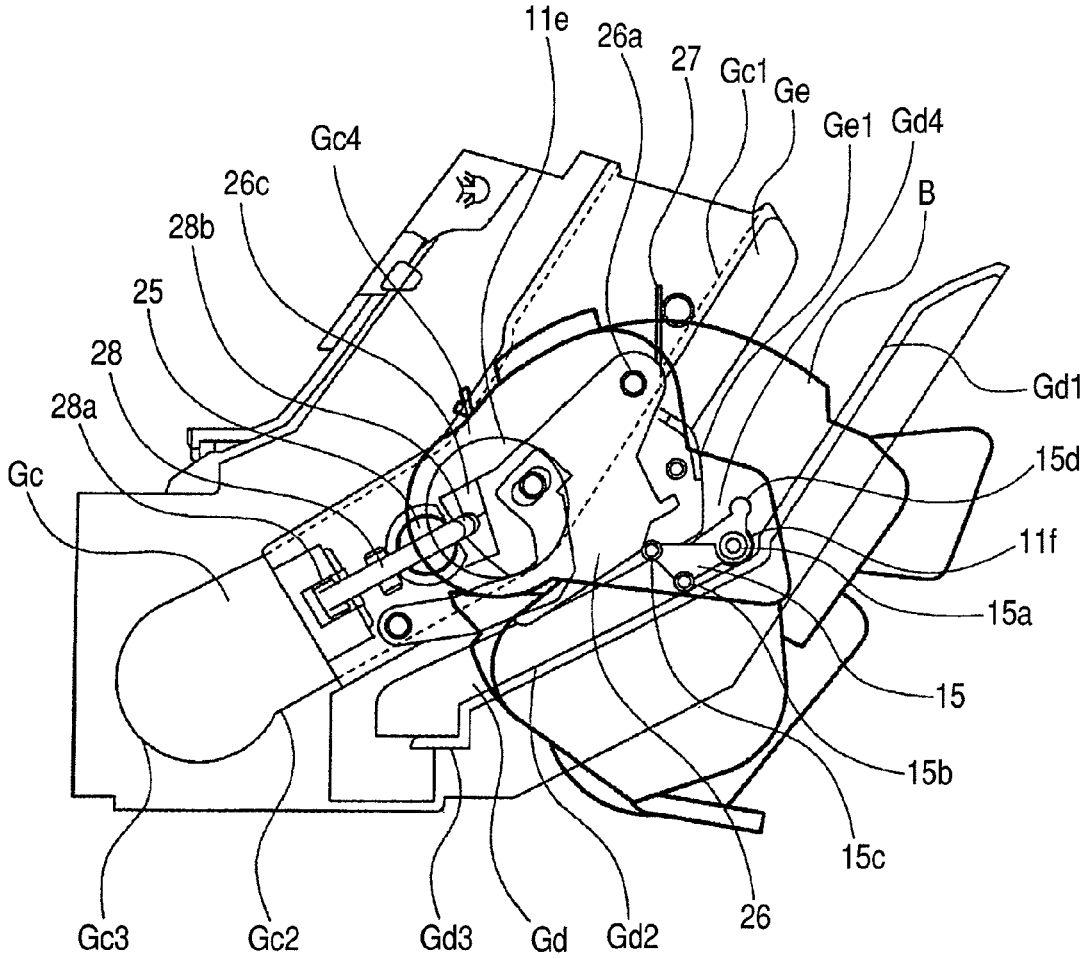
FIG. 14 is a schematic sectional view in the state in which the moving member of the process cartridge abuts on the releasing member in the first embodiment.
Figure 15:
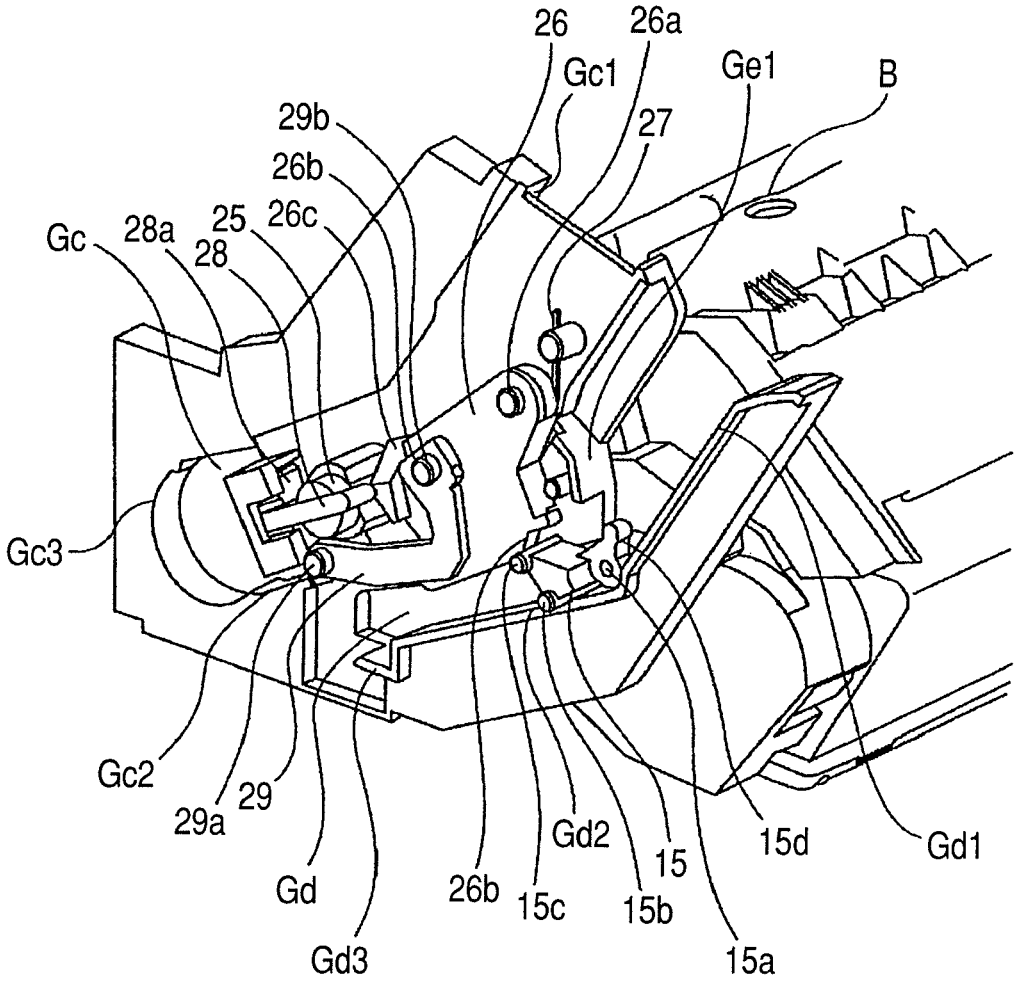
FIG. 15 is schematic perspective view in the state in which the moving member of the process cartridge abuts on the releasing member in the first embodiment.
Figure 16:
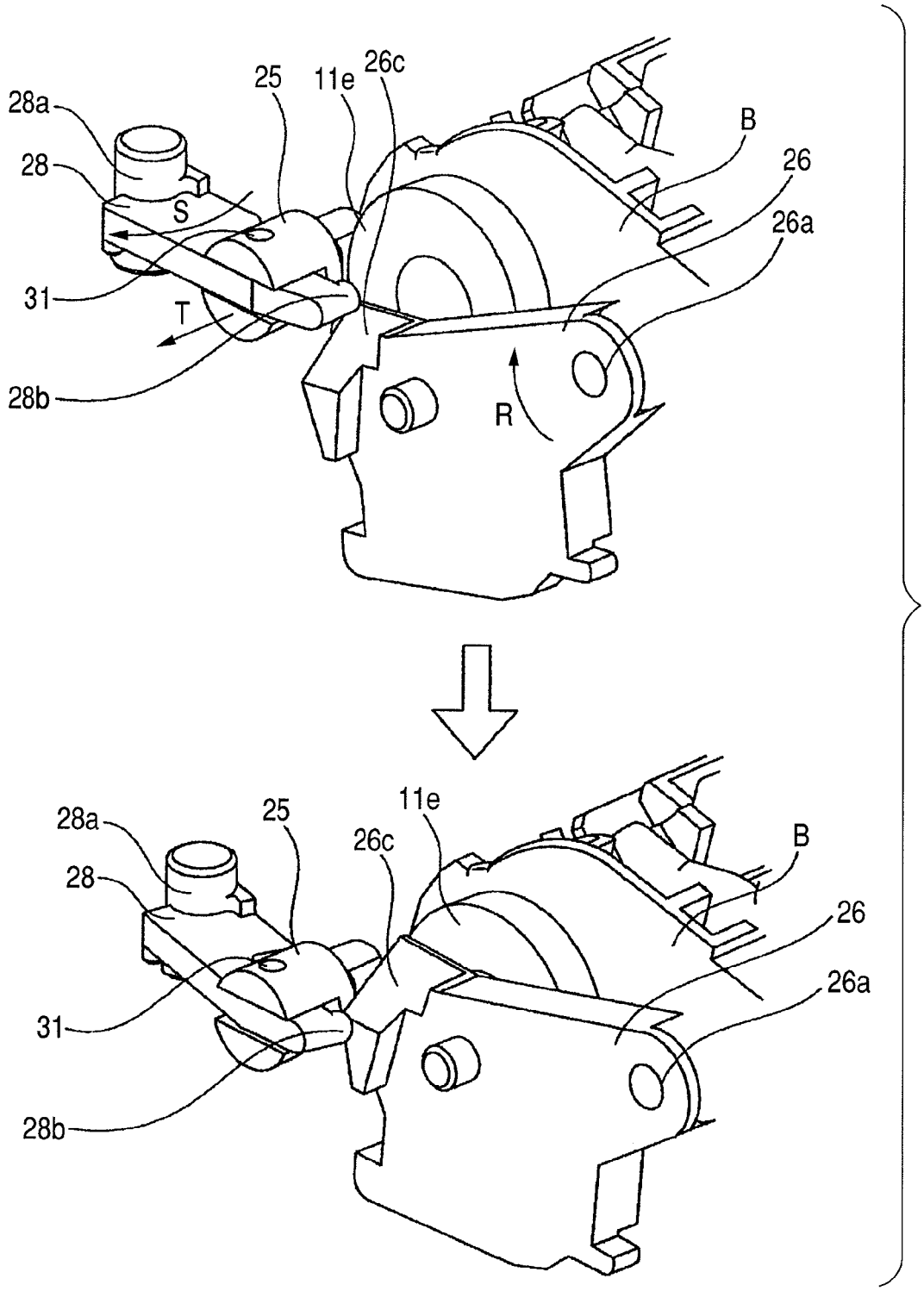
FIG. 16 is a schematic perspective view illustrating the operation of the retreating mechanism of the abutted portion of the image forming apparatus main body in the first embodiment.
Figure 17:
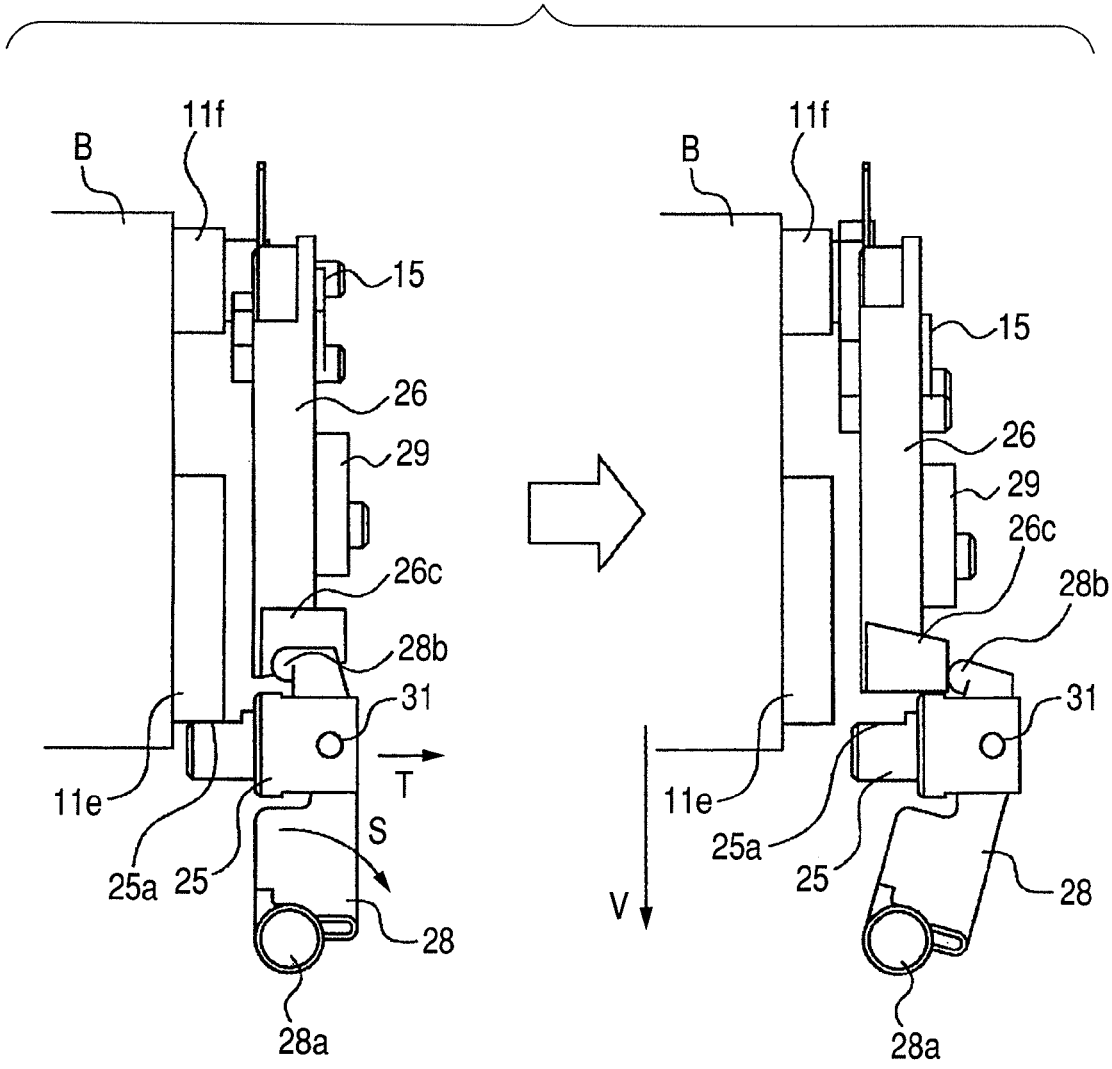
FIG. 17 is a schematic view illustrating the operation of the retreating mechanism of the abutted portion of the image forming apparatus main body in the first embodiment.
Figure 18:
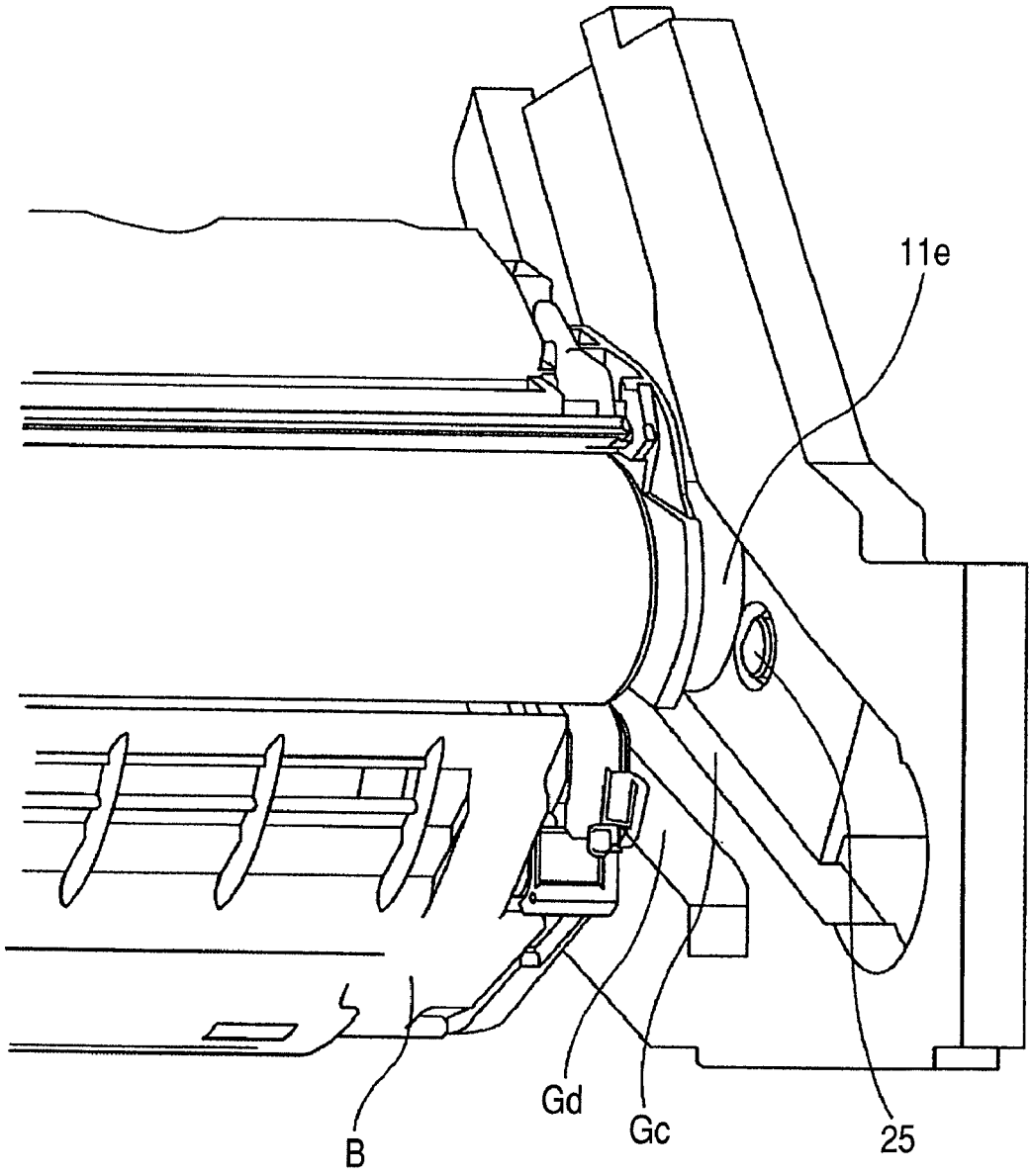
FIG. 18 is a schematic perspective view in the state in which the abutted portion of the image forming apparatus main body is retreated in the first embodiment.

FIG. 13 is a schematic sectional view in the state in which the moving member 15 abuts on the releasing member 26. FIGS. 14 and 15 are a schematic sectional view and a schematic perspective view, respectively in the state in which the moving member 15 acts on the releasing member 26. Further, FIGS. 16 and 17 are a schematic perspective view and a schematic sectional view, respectively, illustrating the operation of a retreating mechanism of the abutted member 25 of the apparatus main body A. FIG. 18 is a schematic perspective view in the state in which the abutted member 25 of the apparatus main body A is retreated in an allowable position.

As described above, the first guided portion 11*e* is placed on the first guide surface Gc1 and the second guided portion 11*f* is inserted into the guide groove Gd, and thus the cartridge B will be mounted into the interior of the apparatus main body A.

Due to the abutment of the first guided portion 11*e* on the abutted member 25, the cartridge B is temporarily stopped as the cartridge B is being mounted in the apparatus main body A.

With the arrangement, a user can adjust the posture of the cartridge B with the first guided portion 11*e* of the cartridge B being as a center in the vicinity of the first bent portion Gc4. Then, the posture of the cartridge B can be controlled to follow the guide shape. That is, due to the abutment of the first guided portion 11*e* on the abutted member 25, the user notices that the cartridge B has not been mounted to the mounting portions Ga3, Gc3. Further, by the cartridge B being pushed further to the downstream side in the mounting direction by the user, the cartridge B will be reliably mounted to the mounting portion Ga3, Gc3. In the case where the main body guide is bent as in this embodiment, such a construction that operates as described above is an effective arrangement for reliably mounting the cartridge B in the apparatus main body A.

As illustrated in FIGS. 8 and 13, the guide portion Ge is provided on the outside in the longitudinal direction of the guide groove Gd. The guide portion Ge is provided in the same position in the longitudinal direction as that of a second abutted portion 15*d* of the moving member 15. Moreover, a second main body abutting portion Ge1 of the image forming apparatus main body is provided in the guide portion Ge. When the cartridge B is adjusted to be in the posture capable of being mounted, the second abutted portion 15*d* of the moving member 15 abuts on the second main body abutting portion Ge1 provided in the guide portion Ge so that the second abutted portion 15*d* is rotated.

As illustrated in FIG. 13, when the cartridge B is rotated in the clockwise direction with the first guided portion 11*e* as the center, the moving member 15 is rotated in the clockwise direction about a rotation center 15*a*, and thus a first abutted portion 15*b* of the moving member 15 abuts on the downstream-side guide portion Gd2 of the second guide groove Gd.

Then, as illustrated in FIGS. 14 and 15, the cartridge B is further rotated in the clockwise direction with the first guided portion 11*e* as the center of rotation. Thus, the second guided portion 11*f* of the cartridge B comes to be in the state of abutting on the downstream-side guide portion Gd2 of the guide grove Gd of the apparatus main body A, and thus the cartridge B will be in such posture as to be capable of being mounted further to the downstream side (into the interior) in the mounting direction. At this time, the moving member 15 is rotated in the clockwise direction about the rotation center 15*a* while the first abutted portion 15*b* abuts on the downstream-side guide portion Gd2. As a result, an acting portion 15*c* of the moving member 15 abuts on an abutting portion 26*b* of the releasing member 26 to cause the releasing member 26 to rotate in the clockwise direction about the rotation center 26*a*.

As illustrated in FIGS. 16 and 17, when the releasing member 26 is rotated in the direction indicated by an arrow R, the abutted portion 26*c* abuts on an abutting portion 28*b* of the retreating lever 28. The abutting portion 28*b* of the retreating lever 28 moves along an inclined surface of the abutted portion 26*c* of the releasing member 26, and the retreating lever 28 turns about a shaft 28*a* (in the direction indicted by an arrow S). According to the rotation of the retreating lever 28, the abutted member 25, which is engaged with the retreating lever 28 via the engaging pin 31, is moved in a sliding manner outward in the longitudinal direction of the cartridge by a linkage mechanism (in the direction indicated by an arrow T). As a result, the abutted member 25 is retreated from the mounting track of the first guided portion 11*e* being mounted (FIGS. 17 and 18). That is, the abutted member 25 is moved to the allowable position for allowing the first guided portion 11*e* to move to the downstream side in the mounting direction.

As a result, the first guided portion 11*e* can move to the downstream-side guide portion Gc2 of the guide groove Gc (in the direction indicated by an arrow V of FIG. 17). The cartridge B, at the same time, is in such a posture that the second guided portion 11*f* can move further into the interior along the downstream-side guide portion Gd2 of the guide Gd. Therefore, the first guided portion 11*e* of the cartridge B moves to the downstream-side guide portion Gc2 of the guide groove Gc and the second guided portion 11*f* thereof moves to the downstream-side guide portion Gd2 of the guide Gd, and thus the cartridge B moves further to the downstream side (into the interior) in the mounting direction of the apparatus main body A. Finally, the first guided portion 11*e* abuts on the arc-shaped mounting portion Gc3 of the guide Gc and the second guided portion 11*f* also abuts on the abutting portion Gd3 of the guide Gd, to complete mounting (refer to FIG. 19). During the movement of the second guided portion 11*f* to the abutting portion Gd3 of the guide Gd, the second guided portion 11*f* of the cartridge and the first abutting portion 15*b* of the moving member 15 abut on the downstream-side guide portion Gd2 of the image forming apparatus main body. Moreover, by the movement of the acting portion 15*c* of the moving member 15 while abutting on the abutting portion 26*b* of the releasing member 26, the abutted member 25 is kept in the state of being retreated from the first guide groove Gc.

When the cartridge B moves to the mounting portion Gc3 (Ga3), the acting portion 15*c* of the moving member 15 is separated from the abutting portion 26*b* of the releasing member 26. Then, the releasing member 26 is biased in the counterclockwise direction by the helical torsion coil spring 27, and the abutted member 25 moves to slide inward in the longitudinal direction of the cartridge again to return to the state of blocking the guide groove Gc, that is to the restraining position.

Incidentally, the other longitudinal direction end (the right side in the inserting direction) also has the same construction as mentioned above. The first guided portion 18*c*1 abuts on the mounting portion Ga3 of the guide Ga, and the second guided portion 18*c*2 abuts on the abutting portion Gb3 (refer to FIG. 4) of the guide Gb. In this state in which mounting has completed, the transfer roller 4 and the photosensitive drum 7 are brought in the abutted state (refer to FIG. 1).

Next, when the opening/closing door 20 that forms the discharge opening 6 of the apparatus main body A is closed, a drive transmission member of the apparatus main body A moves to the cartridge B side, and then is fitted to the end face coupling 7*b*, thus enabling a rotation driving force to be transmitted from the apparatus main body A to the cartridge B.

Figure 20:
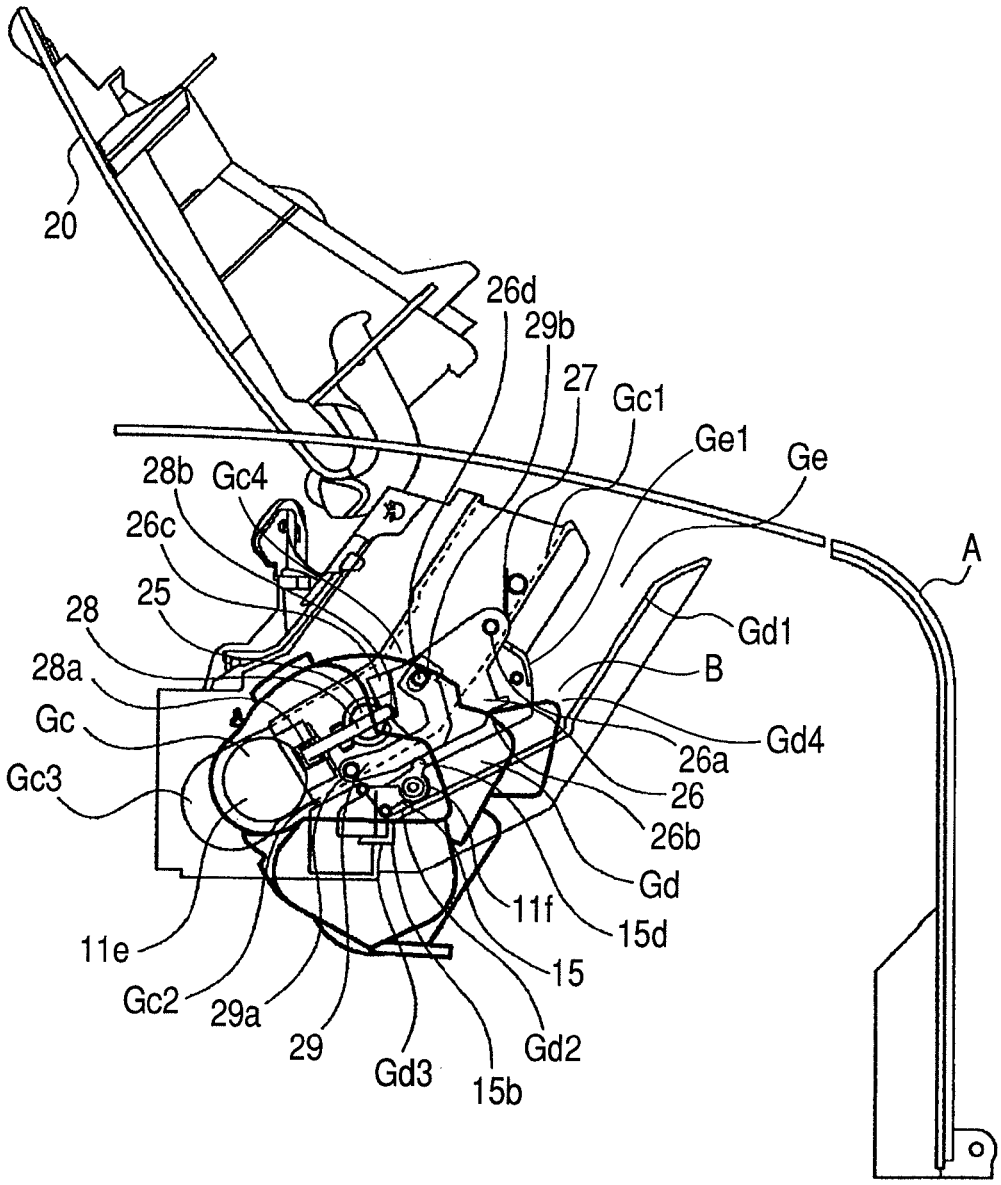
FIG. 20 is a schematic sectional view when pulling the process cartridge out of the image forming apparatus main body in the first embodiment.

Now, the operation of pulling the cartridge B out of the apparatus main body A will be described referring to the drawings. FIG. 20 is a schematic sectional view when pulling the cartridge out of the apparatus main body A.

As illustrated in FIG. 20, when the cartridge B is pulled out of the apparatus main body A, a second abutted portion 15*d* of the moving member 15 abuts on the arm member 29. Here, the arm member 29 includes a rotation center 29*a* at one end portion and pivotally engages with the apparatus main body A, and on the other end side, includes an engaging hole 29*b* and pivotally engages with an engaging protrusion 26*d* of the releasing member 26. When the second abutted portion 15*d* of the moving member 15 abuts on the arm member 29, the arm member 29 is rotated in the counterclockwise direction about the rotation center 29*a*. When the arm member 29 is rotated, the releasing member 26 is rotated in the clockwise direction about the rotation center 26*a*. The retreating lever 28 abuts on the abutted portion 26*c* of the releasing member 26 and moves along the inclined surface of the abutted portion 26*c*, and the retreating lever 28 is rotated in the longitudinal direction of the cartridge about the shaft 28*a*. According to the rotation movement of the retreating lever 28, the abutted member 25 moves to slide outward in the longitudinal direction of the cartridge by the linkage mechanism. In addition, before the guided portion 11*e* reaches the abutted member 25, the abutted member 25 retreats again from the mounting track of the first guided portion 11*e* to move to the allowable position. Until the guided portion 11*e* passes the abutted member 25, the second guided portion 11*f* of the cartridge and the first abutting portion 15*b* of the moving member 15 abut on the downstream-side guide portion Gd2 of the image forming apparatus main body. Furthermore, since the acting portion 15*c* of the moving member 15 moves while abutting on the abutting portion 26*b* of the releasing member 26, the abutted member 25 is kept in the retreated state. As a result, the cartridge B can be pulled out of the apparatus main body A.

Moreover, after the guided portion 11*e* passes the abutted member 25, the acting portion 15*c* of the moving member 15 is separated from the releasing member 26, and the releasing member 26 is biased in the counterclockwise direction by the helical torsion coil spring 27. That is, the abutted member 25 moves to slide and returns to the restraining position of blocking the guide groove Gc again.

Embodiment 2

Figure 21:
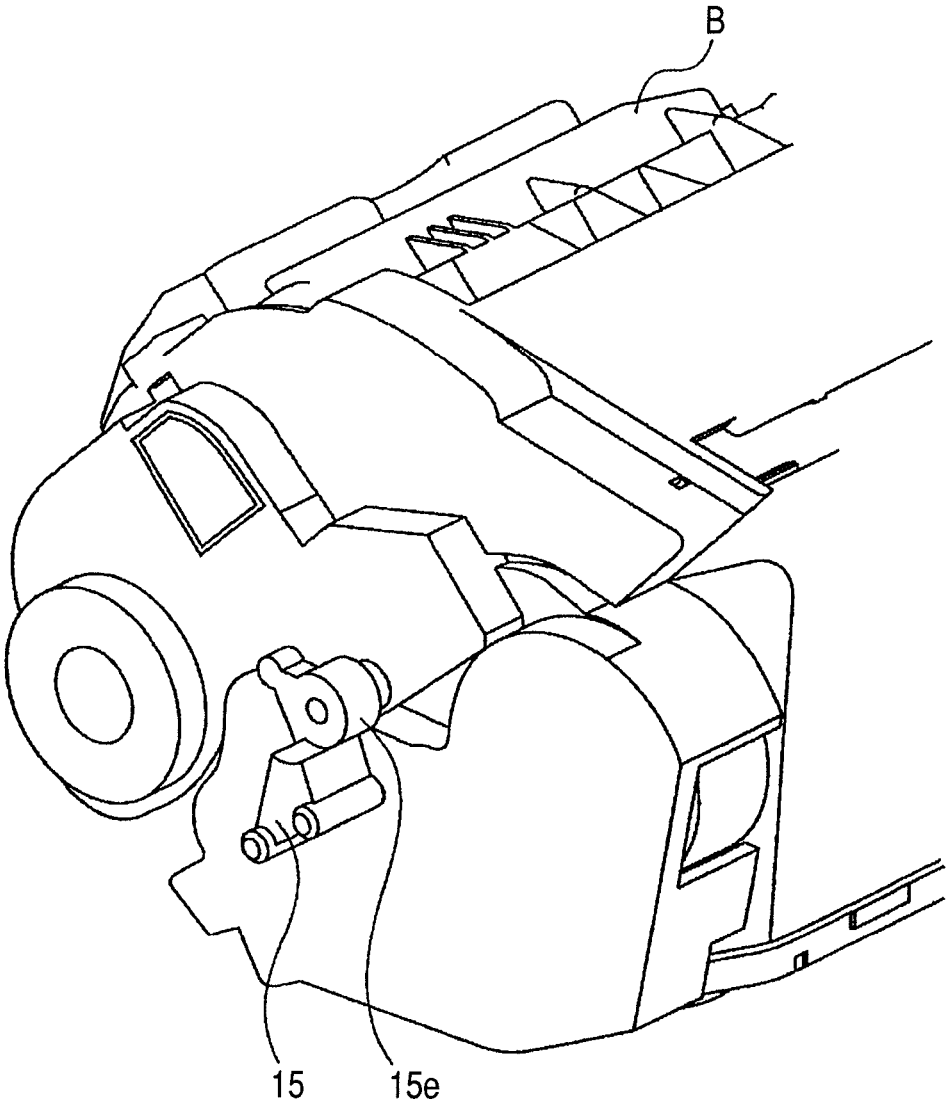
FIG. 21 is a schematic perspective view illustrating the side face of a process cartridge in a second embodiment.
Figure 22:
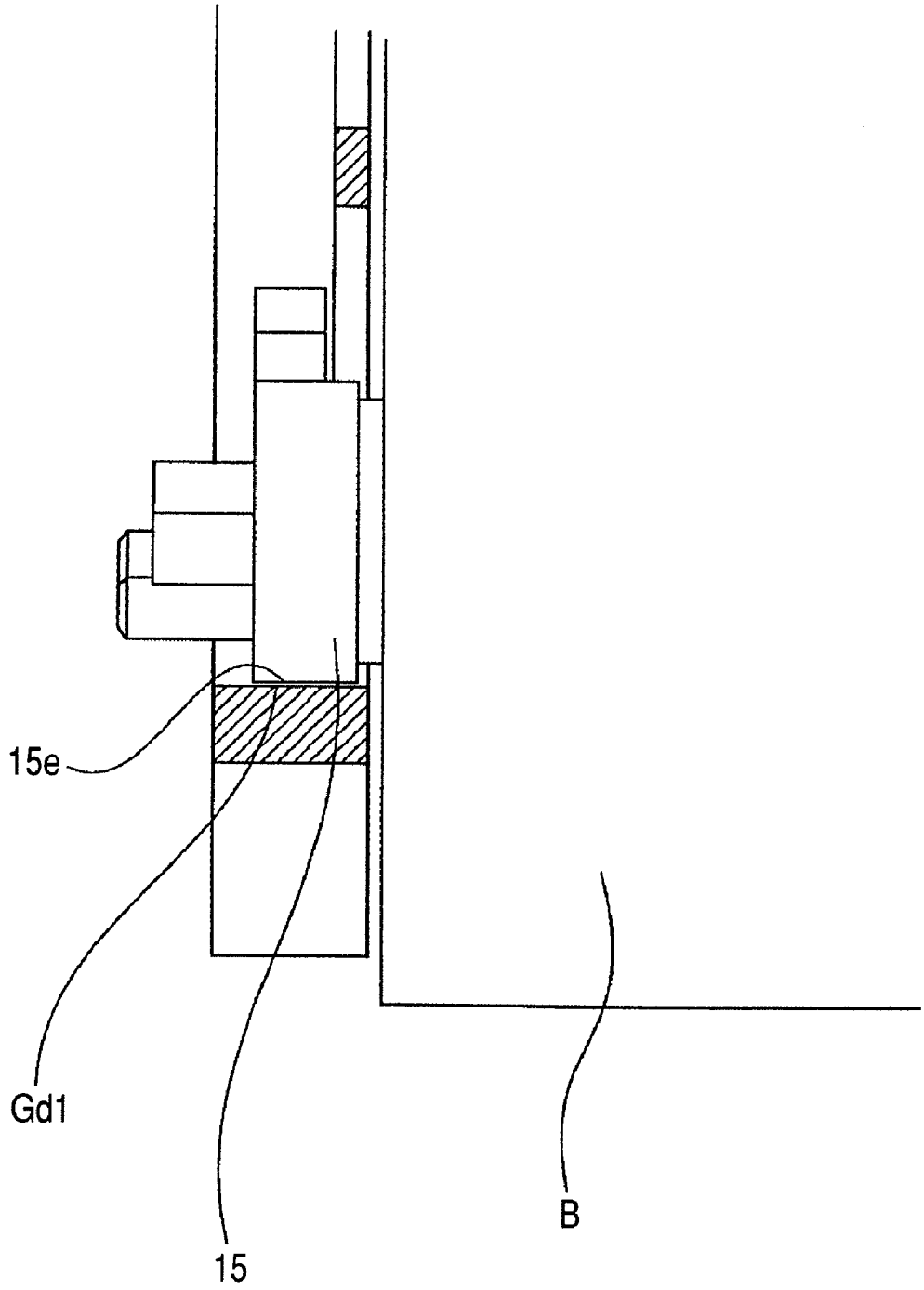
FIG. 22 is a schematic sectional view illustrating the construction of a guide portion between the process cartridge and an image forming apparatus main body in the second embodiment.
Figure 23:
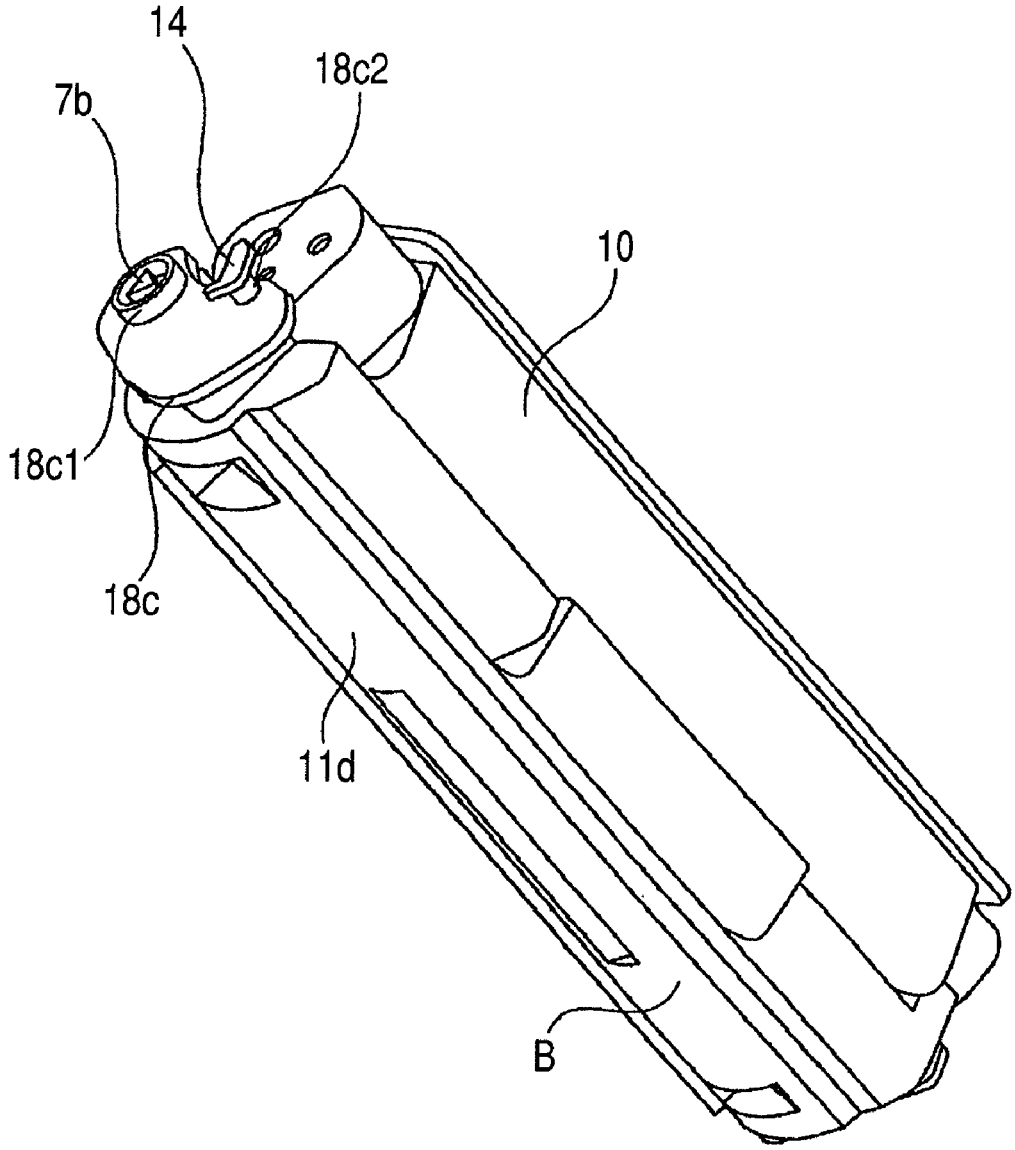
FIG. 23 is a schematic perspective view of a process cartridge in a third embodiment.

Now, a second embodiment according to the present invention will be described referring to the drawings. FIG. 21 is a schematic perspective view illustrating the side face of a cartridge. FIG. 22 is a schematic sectional view illustrating the construction of a guide portion between the cartridge and an image forming apparatus main body.

Although in the first embodiment, the second guided portion 11*f* is provided on the longitudinally outside portion of the cleaning frame 11*d* of the cartridge B, a moving member 15 may also serve as a second guided portion.

That is, as illustrated in FIGS. 21 and 22, it is constructed such that a cylindrical guided portion 15*e* is formed coaxially with a rotation center 15*a* of the moving member 15, and engaged with a guide groove Gd as a second main body guide of the apparatus main body A, to cause the cartridge B to be guided. In addition, a second guided portion on the longitudinally opposite side is of the same construction as well.

Due to the cylindrical guided portion 15*e* being provided on the moving member 15 and also serving as the second guided portion, the cartridge B can be further downsized in the longitudinal direction.

As described heretofore, according to the first embodiment and the second embodiment, the cartridge can be moved on the limited mounting track without being caught in the guide groove of the image forming apparatus main body, and the posture of the cartridge can be smoothly adjusted and controlled. As a result, high operability of the cartridge can be obtained.

Furthermore, due to that arrangement, as is the first embodiment, the apparatus main body A has a guide groove construction having the bent portion, and an unused space in the apparatus main body A can be effectively utilized. In addition, in the apparatus main body A, due to the control of the posture of the cartridge B, the clearance with respect to the apparatus main body A in the vicinity of the mounting track of the cartridge B can be made smaller, so that the apparatus main body A can be downsized.

Moreover, in this construction, the guide construction in the cartridge B and the apparatus main body A is described to be symmetrical. However, even if the above-mentioned construction is provided only on one end side, and only the first guided portion that is coaxial with the photosensitive drum 7 is provided at the other end, the similar effect can be obtained.

That is, on the occasion when a user mounts the cartridge B on the apparatus main body A, at the first bent portion Ga4, the posture of the cartridge B can be adjusted with the first guided portion 11*e* as the center of rotation. Therefore, the posture of the cartridge B can be controlled such that it is easy for the cartridge B to follow the mounting track. Consequently, as is the first embodiment, a high mounting performance of the cartridge B can be achieved.

Furthermore, due to the apparatus main body A having the guide grove having the bent portion, the space in the apparatus main body A can be effectively used. In addition, due to the control of the posture of the cartridge B in the apparatus main body A, the clearance with respect to the apparatus main body A in the vicinity of the mounting track of the cartridge B can be made smaller, so that the apparatus main body A can be downsized.

Embodiment 3

Now, a third embodiment according to the present invention will be described with reference to FIGS. 23 to 33.

The construction in an internal part of a process cartridge B is the same as that of the first embodiment, so that descriptions thereof will be omitted.

(Construction of Mounting/Dismounting a Process Cartridge from an Apparatus Main Body)

A mounting construction of mounting a process cartridge (hereinafter referred to as a cartridge) B on an image forming apparatus main body A will be described with reference to FIGS. 23 to 26.

A bearing member 18*c* is attached to a cleaning frame 11*d* of the cartridge B. Furthermore, at the bearing member 18*c*, as a mounting guide onto the apparatus main body A, there are provided a first guided portion 18*c*1 of a cylindrical shape that is formed to be coaxial with the rotation axis of the photosensitive drum 7 and a second guided portion 18*c*2 as a rotation stopper. The second guided portion 18*c*2 determines the posture of the cartridge B about the axis of the photosensitive drum 7.

Moreover, at the longitudinal direction end portion of the second guided portion 18*c*2, there is a moving member 14 that is rotatably provided at the longitudinal end of the second guided portion 18*c*2. Incidentally, the first guided portion 18*c*1 and the second guided portion 18*c*2 are positioned longitudinally outside of the developing unit 10. In addition, an end face coupling 7*b* that receives a driving force from the apparatus main body A is positioned on the inside side of the bearing member 18*c* in the longitudinal direction.

Figure 24:
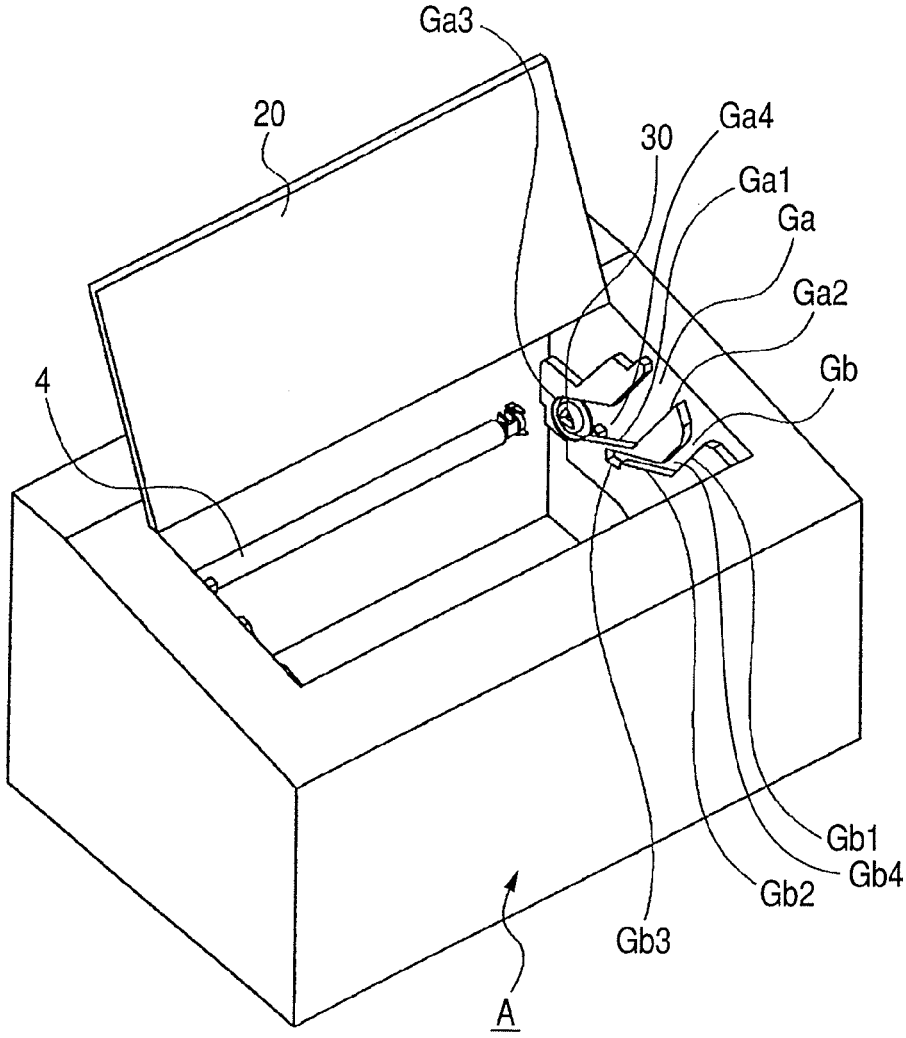
FIG. 24 is a perspective view in the vicinity of a guide groove on the right side of an image forming apparatus main body in the third embodiment.

In the apparatus main body A, as illustrated in FIG. 24, there are formed a guide groove Ga as a first main body guide and a guide groove Gb as a second main body guide for guiding the first guided portion 18*c*1 and the second guided portion 18*c*2 of the cartridge B to mounting portions Ga3, Gc3, being an image forming position. The guide grooves Ga, Gb includes inclined surfaces (upstream-side guide portions Ga1, Gb1) inclined from the top to the bottom thereof toward the downstream side (into the interior) in the mounting direction of the cartridge B. Moreover, the guide grooves Ga, Gb includes inclined surfaces (downstream-side guide portions Ga2, Gb2) at a different angle toward the downstream side (into the interior) in the mounting direction. That is, the guide groove Ga includes a first bent portion Ga4, and the guide groove Gb includes a second bent portion Gb4. Incidentally, the purpose of the guide grooves Ga, Gb including these two inclined surfaces at different angles is to downsize the image forming apparatus, and to make the dead space in the image forming apparatus smaller.

Figure 25:
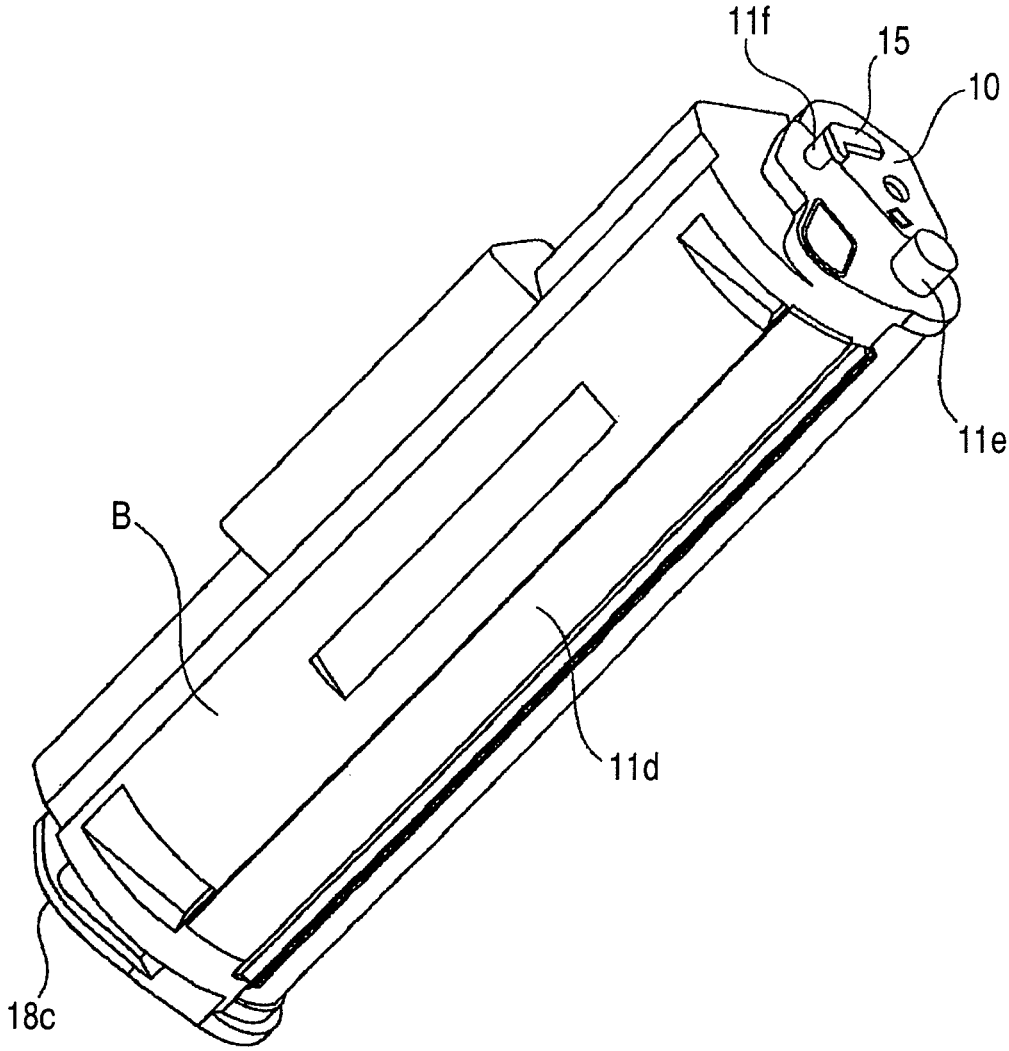
FIG. 25 is a schematic perspective view of the process cartridge in the third embodiment.

On the other hand, as illustrated in FIG. 25, on the other longitudinal direction end side, there are formed a first guided portion 11*e* of a cylindrical shape that is provided coaxially with the photosensitive drum 7 and a second guided portion 11*f* for determining the posture of the cartridge B at the time of mounting. The first and second guided portions 11*e*, 11*f* are parts of the cleaning frame 11*d*. Furthermore, as with the other end, there is a moving member 15 that is rotatably provided at the longitudinal direction end portion of the second guided portion 11*f*. Incidentally, the first guided portion 11*e* and the second guided portion 11*f* are positioned on the outside side of the developing unit 10 in the longitudinal direction.

Figure 26:
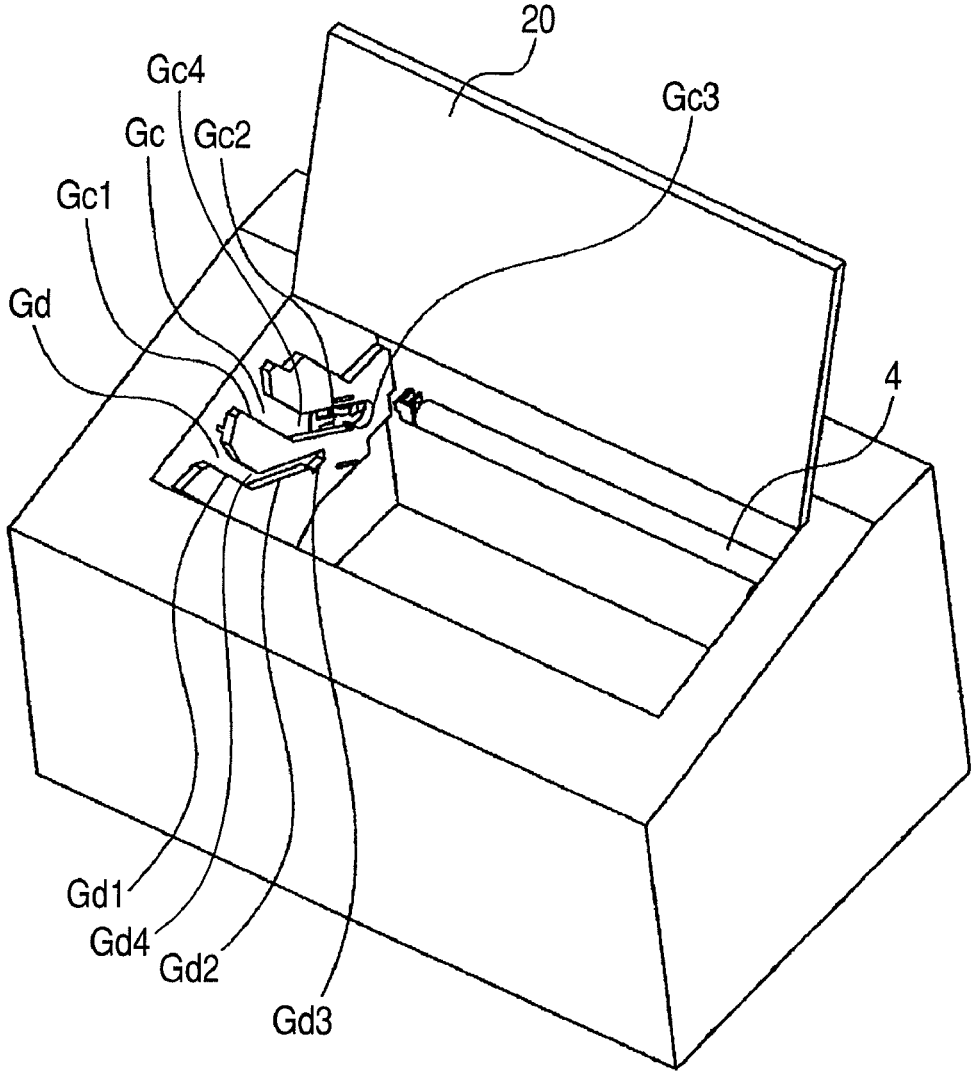
FIG. 26 is a perspective view in the vicinity of a guide grove on the left side of the image forming apparatus main body in the third embodiment.

In addition, in the apparatus main body A, as illustrated in FIG. 26, there are provided a guide grooves Gc, Gd that are formed so as to likewise keep the posture in mounting/dismounting of the cartridge B having been determined on the bearing member 18*c* side on the other longitudinal direction end side as well. As with the guide construction on the right side, the guide grooves Gc, Gd include inclined surfaces (upstream-side guide portions Gc1, Gd1) inclined from the top to the bottom thereof toward the downstream side (into the interior) in the mounting direction of the cartridge B. Further, the guide grooves Gc, Gd include inclined surfaces (downstream-side guide portions Gc2, Gd2) at a different angle toward the downstream side (into the interior) in the mounting direction.

Now, a mounting/dismounting construction of the cartridge B with respect to the apparatus main body A will be described referring to FIGS. 27 to 31. Incidentally, in this mounting/dismounting construction, the guide portions Ga, Gb, Gc, and Gd of the apparatus main body A, and the first guided portions 18*c*1, 11*e*, the second guided portions 18*c*2, 11*f*, and the moving members 14, 15 of the cartridge B have respective similar constructions. Therefore, the construction on the left side in the inserting direction of the cartridge B into the apparatus main body A will be described.

Figure 27:
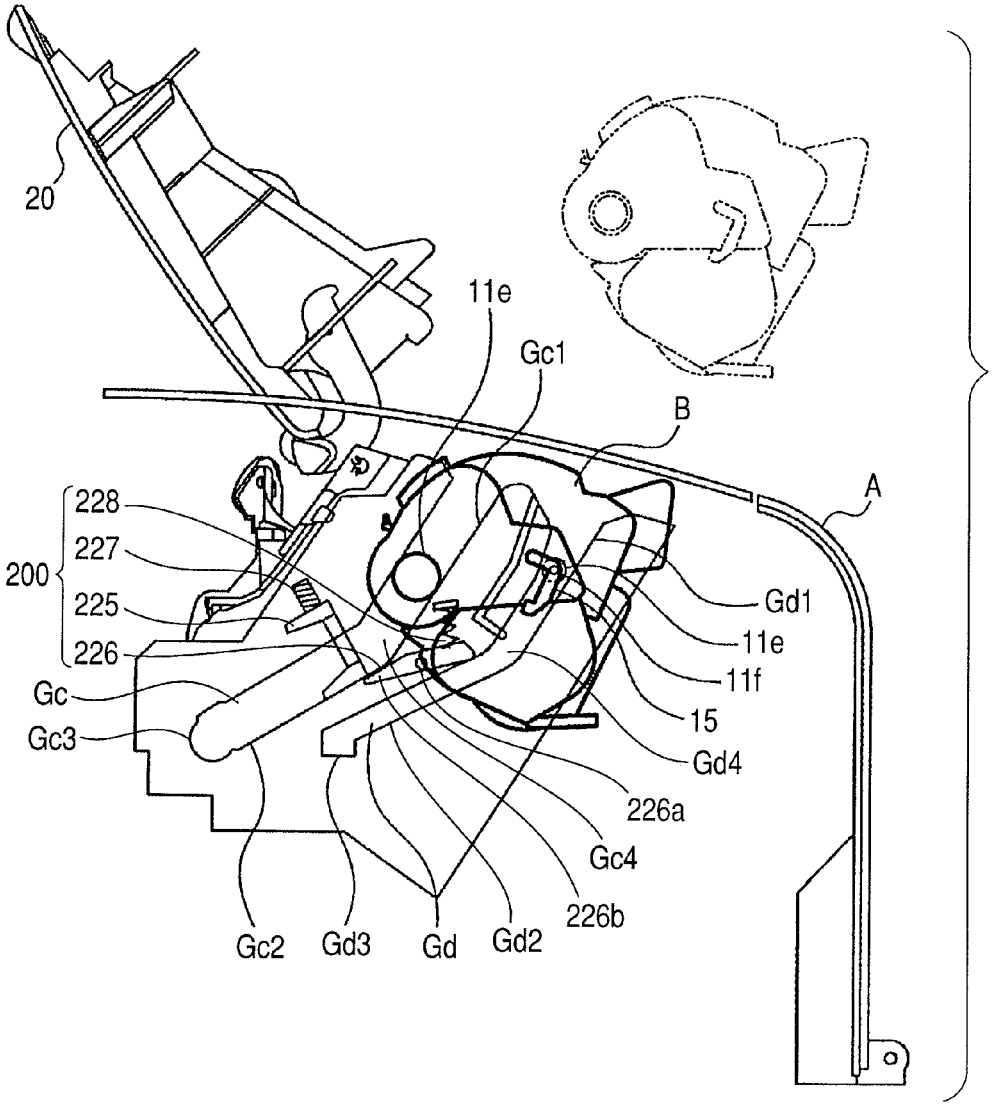
FIG. 27 is a schematic sectional view when mounting the process cartridge in the main body in the third embodiment.
Figure 28:
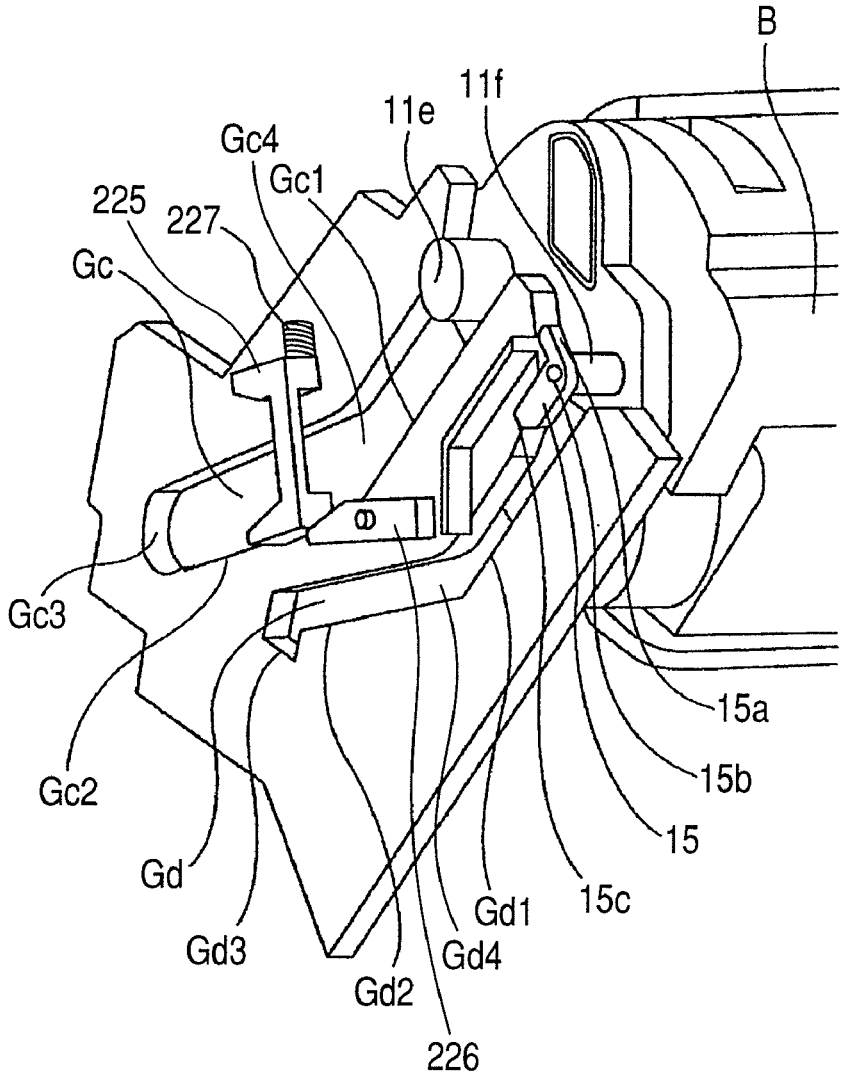
FIG. 28 is a schematic perspective view when mounting the process cartridge in the main body in the third embodiment.

First, as illustrated in FIGS. 27 and 28, the opening/closing door 20 of the apparatus main body A is opened, and the guide grooves Gc, Gd are exposed. The first guided portion 11*e* is placed on the first guide surface Gc1 of which an upstream side in the mounting direction is bent to some extent, of the guide groove Gc and the second guided portion 11*f* is placed on the upstream-side guide portion Gd1 of the guide groove Gd. In this state, the cartridge B is mounted into the interior of the apparatus main body A.

Figure 29:
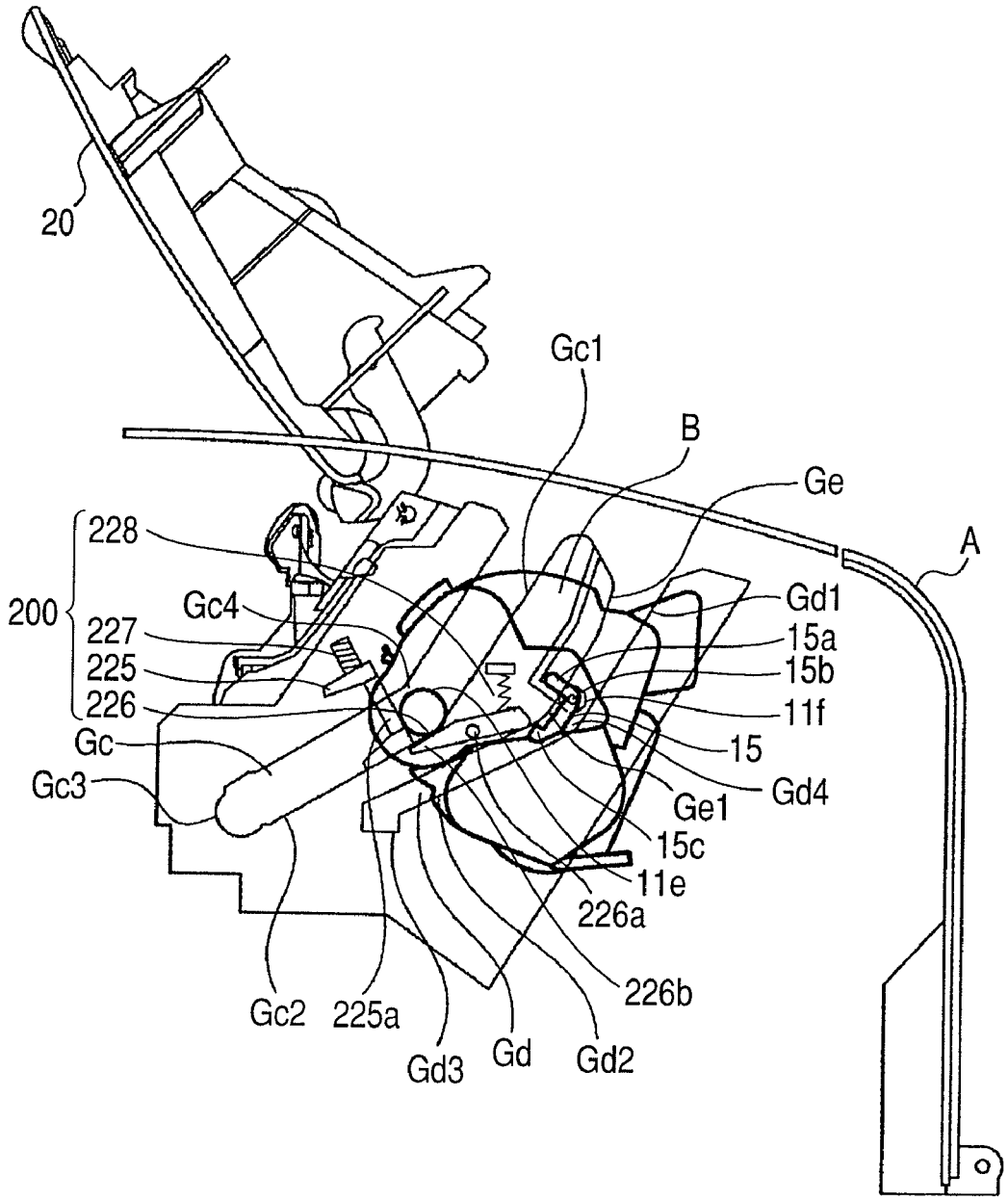
FIG. 29 is a schematic sectional view when mounting the process cartridge in the main body in the third embodiment.

Next, as illustrated in FIG. 29, in this embodiment, a restraining unit 200 includes a shield member 225, a releasing lever 226, a compression spring 227 and a spring 228 biasing the releasing lever 226.

The first guided portion 11*e* abuts on the shield member 225 in the vicinity of the first bent portion Gc4. Here, the shield member 225 will be described. The shield member 225 is supported so as to be capable of vertically sliding, and biased downward by the compression spring 227.

Below the shield member 225, there is provided the releasing lever 226 that can rotate about a rotation center 226*a*, and is biased in the clockwise direction by the spring 228. A shield member abutting portion 226*b* of this releasing lever 226 presses the shield member 225 upward. Incidentally, the biasing force of the releasing lever 226 is larger than the biasing force of the shield member 225, and normally, a shield portion 225*a* of the shield member 225 is positioned in a restraining position of blocking the guide groove Gc.

Due to abutting of the first guided portion 11*e* on the shield member 225, the cartridge B is temporarily stopped as the cartridge B is being mounted in the apparatus main body A.

As a result, a user can easily control the posture of the cartridge B with the first guided portion 11*e* of the cartridge B as the center in the vicinity of the first bent portion Gc4. That is, as with the first embodiment, the cartridge B can be reliably mounted in the apparatus main body A.

Figure 30:
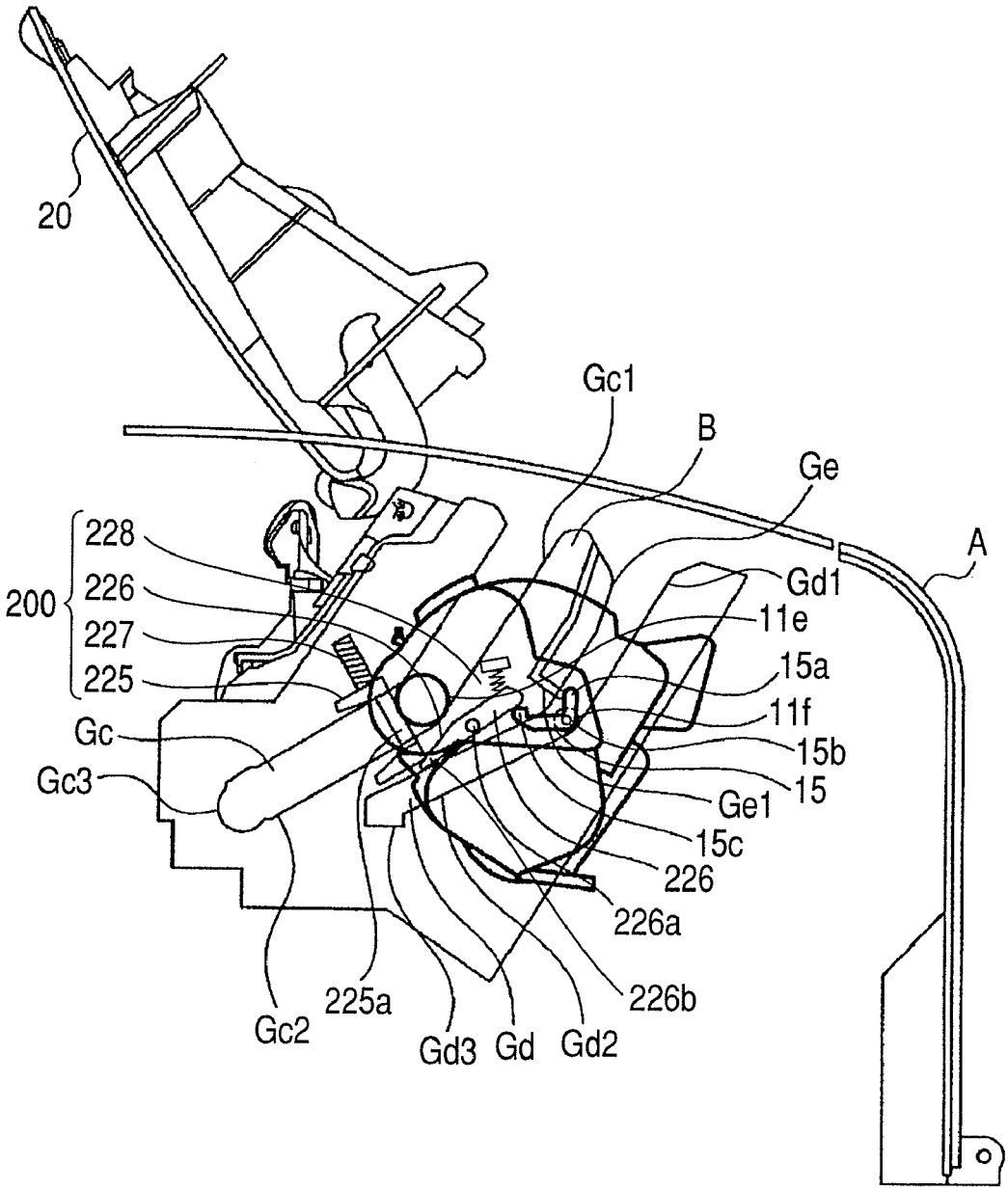
FIG. 30 is a schematic sectional view when mounting the process cartridge in the main body in the third embodiment.
Figure 31:
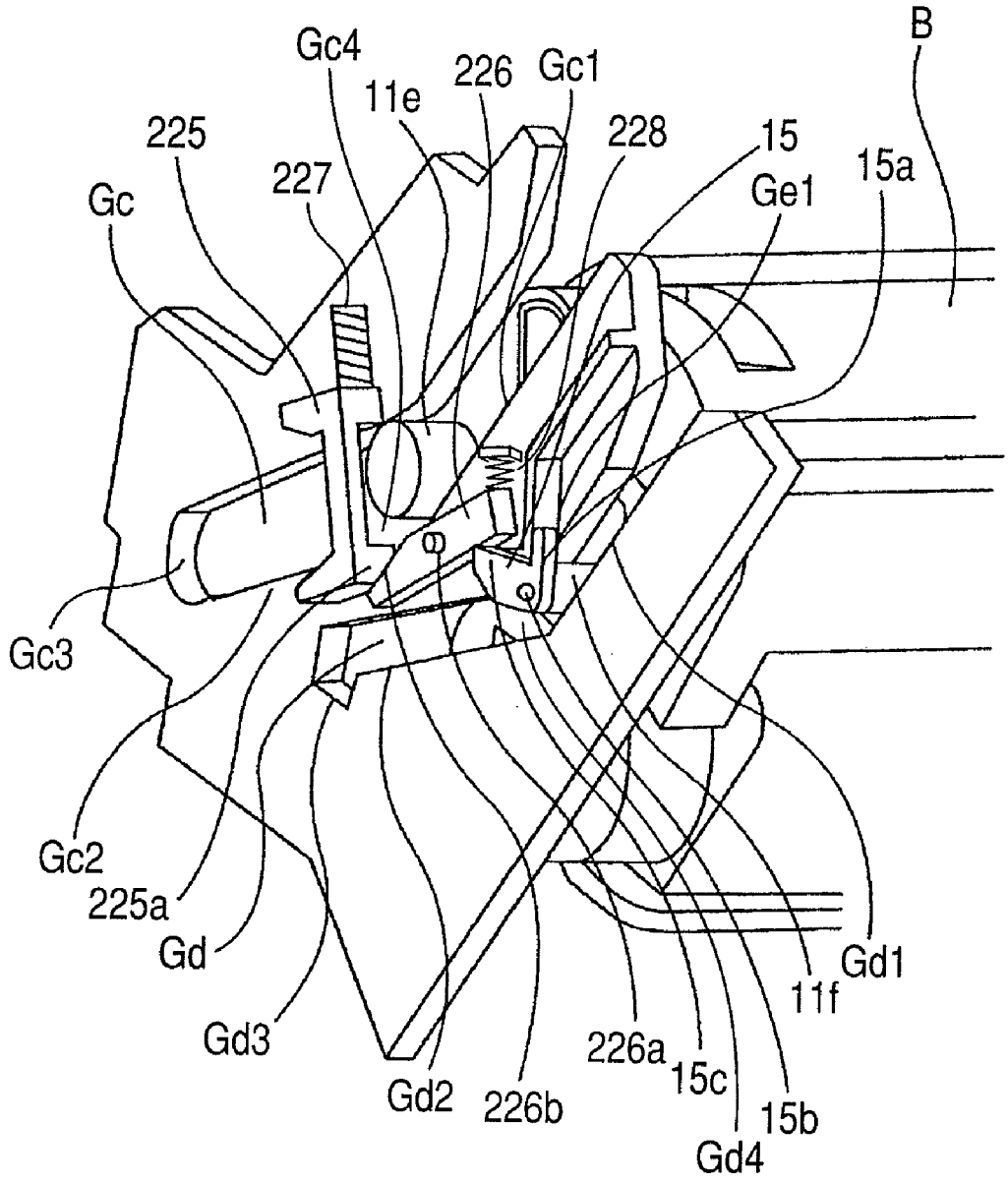
FIG. 31 is a schematic perspective view when mounting the process cartridge in the main body in the third embodiment.
Figure 32:
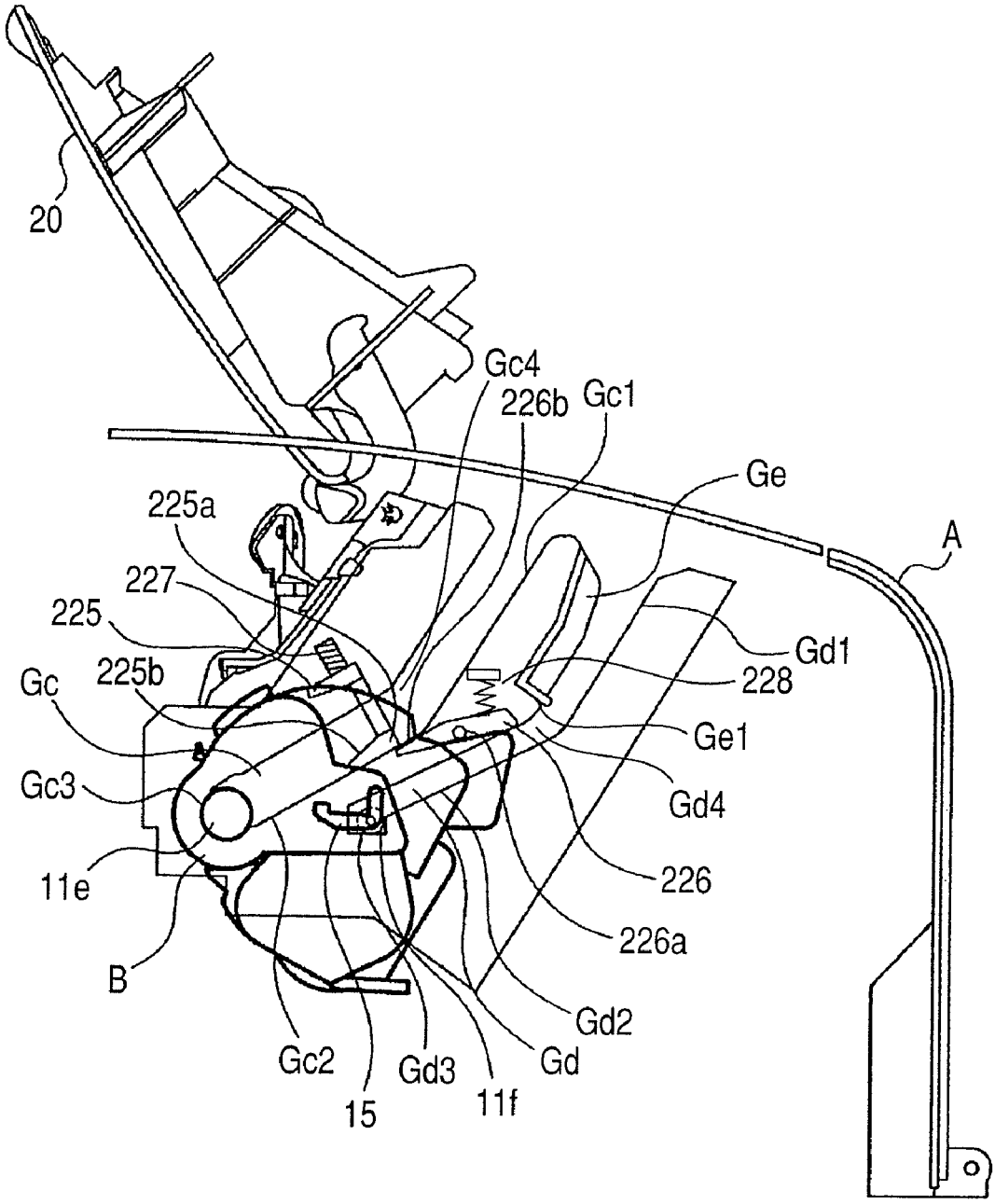
FIG. 32 is a schematic sectional view when mounting the process cartridge in the main body in the third embodiment.

As illustrated in FIGS. 30 to 32, on the outside in the longitudinal direction of the second guide portion Gd, there is a guide portion Ge guiding the moving member 15. Then, when the cartridge B is postured to be capable of being mounted, a first abutting portion 15*a* of the moving member 15 abuts on a protrusion Ge1 (main body abutting portion) that is provided at the guide portion Ge. Then, the moving member 15 is rotated in the clockwise direction about a rotation center 15*b*, and an acting portion 15*c* of the moving member 15 abuts on the releasing lever 226.

Subsequently, the releasing lever 226 is rotated in the counterclockwise direction about the rotation center 226*a* so that the shield member 225 is moved downward by the biasing force of the spring 227 to move the shield member 225 to an allowable position in which the shield portion 225*a* of the shield member 225 is retreated from the mounting track of the first guided portion 11*e*. As a result, the first guided portion 11*e* can move to the downstream-side guide portion Gc2 of the guide groove Gc. At the same time, the cartridge B is postured to be capable of being mounted, so that the second guided portion 11*f* moves to the downstream-side guide portion Gd2 of the guide Gd as well, and finally the first guided portion 11*e* abuts on the mounting portion Gc3 of the guide Gc. Furthermore, the second guided portion 11*f* also abuts on the abutting portion Gd3 of the guide Gd, to complete mounting (refer to FIG. 32).

Incidentally, the other longitudinal direction end (right side in the inserting direction) is likewise in the above-mentioned construction, the first guided portion 18*c*1 abuts on a mounting portion Ga3 of the guide Ga and the second guided portion 18*c*2 abuts on an abutting portion Gb3 of the guide Gb (as to the mounting portion Ga3 and the abutting portion Gb3, refer to FIG. 24). In this mounting completion state, the transfer roller 4 and the photosensitive drum 7 are in the abutted state.

Then, when the opening/closing door 20 that forms the discharge opening 6 of the apparatus main body A is closed, a drive transmission member of a twisted and substantially recessed-triangular shape of the apparatus main body A moves to the cartridge B side. Then, the drive transmission member is fitted to the end face coupling 7*b* of the cartridge B, and thus a rotation driving force is transmitted to the cartridge B from the apparatus main body A.

Figure 33:
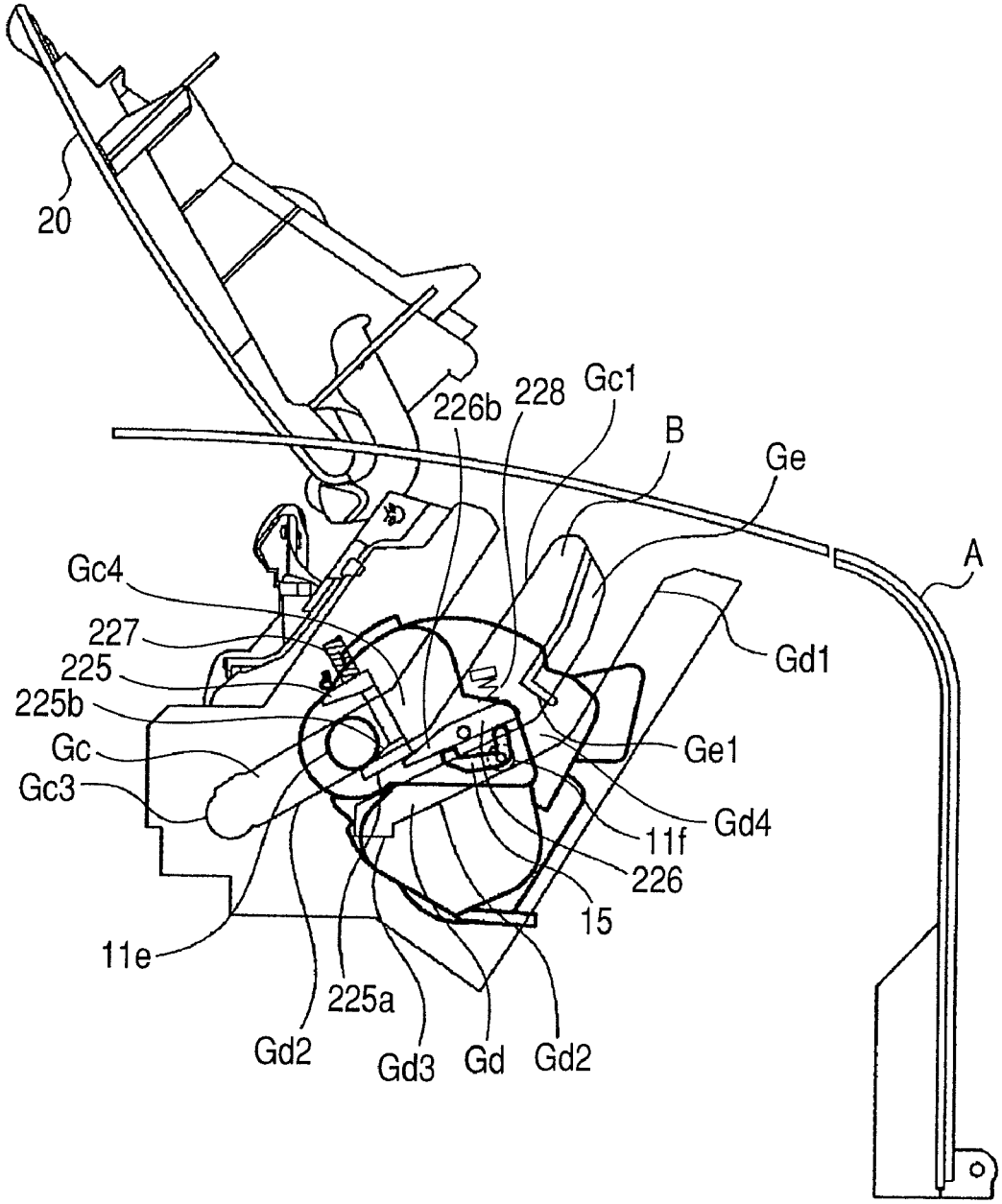
FIG. 33 is a schematic sectional view when mounting the process cartridge in the main body in the third embodiment.

As illustrated in FIG. 33, when the cartridge B is pulled out of the image forming apparatus A, the first guided portion 11*e* pushes downward an inclined surface 225*b* of the shield member 225 and passes through the guide groove Gc. Furthermore, at the same time, the second guided portion 11*f* passes through the guide portion Gd, and eventually the cartridge B can be pulled out of the apparatus main body A.

As described heretofore, the posture of the cartridge B can be controlled such that the cartridge B can easily follow the limited mounting track. As a result, high operability of the cartridge B can be obtained.

Moreover, due to the inclusion in the apparatus main body A of the guide groove having the bent portion, the unused space in the image forming apparatus main body A can be effectively utilized. In addition, due to the control of the posture of the cartridge B in the apparatus main body A, the clearance with respect to the apparatus main body A in the vicinity of the mounting track of the cartridge B can be made smaller, so that the apparatus main body A can be downsized.

Moreover, in this construction, the guide construction in the cartridge B and the apparatus main body A is described to be symmetrical. However, even if the above-mentioned construction is provided only on one end side, and only the first guided portion that is coaxial with the photosensitive drum 7 is provided on the other end, the similar effect can be obtained.

Embodiment 4

In the above-described embodiments 1 to 3, descriptions are provided using a process cartridge including a photosensitive drum and a process unit. However, it is preferable to be a developing cartridge including a developing unit for developing an electrostatic latent image that is formed on an electrophotographic photosensitive member, the developing cartridge being detachably mountable to an image forming apparatus main body provided with the electrophotographic photosensitive member.

Heretofore, according to the present invention, the electrophotographic image forming apparatus main body can be downsized, and further, high operability on the occasion when the cartridge is mounted or dismounted from the electrophotographic image forming apparatus main body can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-336008, filed Dec. 13, 2006, and 2007-304501, filed Nov. 26, 2007 which are hereby incorporated by reference herein in their entirety.

What is claimed is:

1. A cartridge detachably mountable to an electrophotographic image forming apparatus main body for forming an image on a recording medium, the electrophotographic image forming apparatus main body having a main body guide, a restraining unit provided movably with respect to the main body guide, and a main body abutting portion, the cartridge comprising:

a frame;

a guided portion protruding from said frame so as to be guided by the main body guide, and abutting the restraining unit as said cartridge is being mounted to the image forming apparatus main body so as to be restrained from moving to a downstream side in a mounting direction; and a moving member provided movably with respect to said frame, and abutting the main body abutting portion so as to be moved to act on the restraining unit, and thereby moving the restraining unit, which the guided portion abuts, to an allowable position for allowing said guided portion to move to the downstream side in the mounting direction when said cartridge is mounted to the apparatus.

2. A cartridge according to claim 1, wherein said cartridge further includes a second guided portion to be guided by a second main body guide that is provided at the apparatus main body when said cartridge is mounted to the apparatus, said second guided portion movably supporting said moving member.

3. A cartridge according to claim 2, wherein said moving member abuts the main body abutting portion so as to be moved to abut the second main body guide, and thereafter acts on the restraining unit when said cartridge is mounted to the apparatus.

4. A cartridge according to claim 1, wherein said moving member is a second guided portion to be guided by a second main body guide when said cartridge is mounted to the apparatus, the second main body guide being provided at the apparatus main body.

5. A cartridge according to claim 1, wherein said moving member is provided rotatably about a rotation center, and includes an abutted portion to abut the main body abutting portion when said cartridge is mounted to the apparatus and an acting portion to act on the restraining unit when said cartridge is mounted to the apparatus.

6. A cartridge according to claim 1, wherein said moving member is adapted to abut the main body abutting portion after said guided portion abuts the restraining unit when said cartridge is mounted to the apparatus.

7. A cartridge according to claim 1, wherein said cartridge is a process cartridge including an electrophotographic photosensitive member and a process unit acting on said electrophotographic photosensitive member.

8. An electrophotographic image forming apparatus to which a cartridge is detachably mountable for forming an image on a recording medium, the electrophotographic image forming apparatus comprising:

(i) a main body guide;

(ii) a restraining unit provided movably with respect to said main body guide;

(iii) a main body abutting portion;

(iv) a mounting portion to which the cartridge is detachably mountable, the cartridge including:

a frame;

a guided portion protruded from the frame so as to be guided by said main body guide, and abutting said restraining unit as the cartridge is being mounted to an apparatus main body of said electrophotographic image forming apparatus so as to be restrained from moving to a downstream side in a mounting direction; and a moving member provided movably with respect to the frame, abutting said main body abutting portion so as to be moved to act on said restraining unit, and thereby moving said restraining unit, which the guided portion abuts, to an allowable position for allowing the guided portion to move to the downstream side in the mounting direction; and (v) a conveying unit conveying the recording medium.

9. An electrophotographic image forming apparatus according to claim 8, wherein said main body guide includes a bent portion that is bent.

10. An electrophotographic image forming apparatus according to claim 8, further comprising a second main body guide guiding a second guided portion of the cartridge when the cartridge is mounted to said apparatus.

11. An electrophotographic image forming apparatus according to claim 10, wherein said second main body guide includes a second bent portion that is bent.

12. An electrophotographic image forming apparatus according to claim 8, wherein said restraining unit includes an abutted member which is provided movably with respect to said main body guide, and which the guided portion abuts when the cartridge is mounted to said apparatus, and a releasing member, which is moved by the moving member abutting said releasing member so as to move said abutted member to the allowable position when the cartridge is mounted to said apparatus.

13. An electrophotographic image forming apparatus according to claim 12, wherein when the guided portion abuts said abutted member, said abutted member protrudes into said main body guide to restrict the guided portion from moving to the downstream side in the mounting direction.

14. An electrophotographic image forming apparatus according to claim 12, wherein when the cartridge is removed from said mounting portion, said releasing member is moved by the moving member abutting said releasing member so as to move said abutted member to the allowable position.

15. An electrophotographic image forming apparatus according to claim 12, wherein said restraining unit includes an arm member engaged with said releasing member, wherein when the cartridge is removed from said mounting portion, said arm member is moved by the moving member abutting said arm member to move said releasing member so as to move said abutted member to the allowable position.

* * * * *